US011510495B1

(12) United States Patent
Machin et al.

(10) Patent No.: US 11,510,495 B1
(45) Date of Patent: Nov. 29, 2022

(54) CHAIR HAVING AN ACCESSORY HOOK

(71) Applicant: Steelcase Inc., Grand Rapids, MI (US)

(72) Inventors: Keith Robert Machin, Hopkins, MI (US); Mark Schneider, Alto, MI (US); David O. Morton, Grand Rapids, MI (US); Ryan Jerome Ramos, Milwaukee, WI (US); Mark Spoelhof, Grand Rapids, MI (US); Jamie Payne, Grand Rapids, MI (US); Daniel George Parker, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 17/320,994

(22) Filed: May 14, 2021

(51) Int. Cl.

| | |
|---|---|
| ***A47C 7/42*** | (2006.01) |
| ***A47C 7/62*** | (2006.01) |
| ***A47C 7/64*** | (2006.01) |
| ***A47C 5/04*** | (2006.01) |
| *A47C 7/00* | (2006.01) |
| *A47C 3/04* | (2006.01) |

(52) U.S. Cl.
CPC ..... *A47C 7/42* (2013.01); *A47C 5/04* (2013.01); *A47C 7/62* (2013.01); *A47C 7/64* (2013.01); *A47C 3/04* (2013.01); *A47C 7/006* (2013.01)

(58) Field of Classification Search
CPC ..... B60N 2/2209; B60N 2/305; A47C 7/62; A47C 7/64
See application file for complete search history.

(56) References Cited

U.S. PATENT DOCUMENTS

| | | | |
|---|---|---|---|
| 2,967,565 | A | 1/1961 | Schultz |
| 3,100,459 | A | 8/1963 | Liss et al. |
| D226,173 | S | 1/1973 | Hermanson |
| 3,774,960 | A | 11/1973 | Blodee |
| 3,847,433 | A | 11/1974 | Acton et al. |
| 3,982,785 | A | 9/1976 | Ambasz |
| 4,057,288 | A | 11/1977 | Schwartz et al. |
| 4,083,525 | A | 4/1978 | Rath |

(Continued)

FOREIGN PATENT DOCUMENTS

| | | |
|---|---|---|
| AR | 069556 A4 | 2/2010 |
| AU | 7296/22 | 6/1922 |

(Continued)

OTHER PUBLICATIONS

International Search Report of International Application No. PCT/US2022/027475, dated Jul. 29, 2022, 2 pages.

(Continued)

*Primary Examiner* — Timothy J Brindley
(74) *Attorney, Agent, or Firm* — Quarles & Brady LLP

(57) ABSTRACT

A seating unit includes a chair with a backrest and a hook assembly. The backrest includes a rear surface having an outwardly protruding rim. The hook assembly comprises a cover plate and a weldment, and the cover plate may include a hook being integrally formed on an exterior face. The hook assembly is configured to be securely coupled on or within the outwardly protruding rim of the backrest, and a secure coupling between the hook assembly and the backrest is formed via insertion of a fastening member, which is inserted through an apertures on a bottom surface of the cover plate, such that the fastener is aligned substantially parallel to the rear surface.

18 Claims, 14 Drawing Sheets

(56) References Cited

U.S. PATENT DOCUMENTS

| | | | | |
|---|---|---|---|---|
| D289,139 | S | 4/1987 | Chasen | |
| 4,711,488 | A | 12/1987 | Ohanessian | |
| D296,759 | S | 7/1988 | Greenhut et al. | |
| D327,213 | S | 6/1992 | Murphy | |
| D339,058 | S | 9/1993 | Greenhut et al. | |
| 5,242,211 | A | 9/1993 | Grad et al. | |
| D345,298 | S | 3/1994 | Rosenthal | |
| 5,415,457 | A | 5/1995 | Kifer | |
| 5,498,052 | A * | 3/1996 | Severini | B60N 2/20 297/14 |
| D385,479 | S | 10/1997 | Hofman | |
| D386,389 | S | 11/1997 | Hofman | |
| 5,836,646 | A | 11/1998 | Salehi et al. | |
| D404,287 | S | 1/1999 | Hepworth | |
| 5,863,092 | A | 1/1999 | Kifer | |
| 5,954,396 | A | 9/1999 | Kemnitzer | |
| D417,385 | S | 12/1999 | Bries et al. | |
| 5,997,094 | A | 12/1999 | Cvek | |
| 6,030,037 | A | 2/2000 | Ritch et al. | |
| 6,142,566 | A | 11/2000 | Ritch et al. | |
| 6,286,901 | B1 | 9/2001 | Ritch et al. | |
| 6,808,093 | B1 * | 10/2004 | Lin | A47C 7/64 297/188.03 |
| 6,908,159 | B2 | 6/2005 | Prince et al. | |
| D511,914 | S | 11/2005 | Edwards et al. | |
| 7,147,286 | B2 | 12/2006 | Cesaroni et al. | |
| 7,219,868 | B2 | 5/2007 | Marler et al. | |
| 7,270,371 | B2 * | 9/2007 | Adragna | B60N 2/3093 296/65.09 |
| D570,486 | S | 6/2008 | White | |
| 7,517,008 | B2 * | 4/2009 | Ebel | B60N 2/3031 297/14 |
| D603,688 | S | 11/2009 | Chiu | |
| 7,717,511 | B2 | 5/2010 | Huang | |
| 7,731,284 | B2 * | 6/2010 | Lhomme | B60N 2/2869 297/256.16 |
| 7,794,016 | B1 | 9/2010 | Lucci et al. | |
| 7,850,241 | B1 | 12/2010 | Lucci et al. | |
| 7,972,100 | B2 | 7/2011 | Horvath et al. | |
| 8,002,225 | B1 | 8/2011 | Malone | |
| 8,061,775 | B2 | 11/2011 | Diffrient | |
| D650,655 | S | 12/2011 | Wester | |
| 8,096,621 | B2 | 1/2012 | Braun | |
| 8,272,610 | B2 | 9/2012 | Ernst et al. | |
| 8,303,018 | B2 * | 11/2012 | Zambon | B60N 2/3031 296/65.02 |
| D673,401 | S | 1/2013 | Diffrient | |
| 8,397,963 | B2 | 3/2013 | Singh | |
| 8,540,315 | B2 | 9/2013 | Piretti | |
| 8,573,415 | B2 | 11/2013 | Ernst et al. | |
| 8,657,374 | B2 | 2/2014 | Higgs | |
| D705,644 | S | 5/2014 | Swy | |
| 8,777,077 | B2 | 7/2014 | McClain | |
| D714,621 | S | 10/2014 | Pan | |
| 8,967,714 | B2 | 3/2015 | Machael et al. | |
| D756,755 | S | 5/2016 | Kuehn | |
| D770,196 | S | 11/2016 | Swy | |
| 9,504,326 | B1 | 11/2016 | Cartis et al. | |
| 9,510,682 | B2 | 12/2016 | Hasegawa et al. | |
| D805,374 | S | 12/2017 | Shoenhair et al. | |
| D811,862 | S | 3/2018 | Berger et al. | |
| D812,454 | S | 3/2018 | Berger et al. | |
| D821,184 | S | 6/2018 | Berger et al. | |
| D822,467 | S | 7/2018 | Shoenhair et al. | |
| 10,219,631 | B1 | 3/2019 | Jimenez | |
| D853,223 | S | 7/2019 | Chang et al. | |
| 10,358,093 | B1 | 7/2019 | Ewel et al. | |
| D872,567 | S | 1/2020 | Bond et al. | |
| D877,606 | S | 3/2020 | Strothmann et al. | |
| 10,634,183 | B2 | 4/2020 | Matthews | |
| D885,876 | S | 6/2020 | Strothmann et al. | |
| D887,254 | S | 6/2020 | Bond et al. | |
| 2006/0232109 | A1 | 10/2006 | Olano | |
| 2007/0222266 | A1 | 9/2007 | Lucci et al. | |
| 2008/0238165 | A1 | 10/2008 | Freestone et al. | |
| 2008/0284229 | A1 * | 11/2008 | Masunaga | A47C 7/38 297/452.18 |
| 2012/0205948 | A1 | 8/2012 | Okuda et al. | |
| 2014/0287188 | A1 * | 9/2014 | Naitou | B68G 7/12 428/99 |
| 2018/0213941 | A1 | 8/2018 | Storiko | |
| 2019/0142167 | A1 | 5/2019 | Lenhart et al. | |

FOREIGN PATENT DOCUMENTS

| | | | |
|---|---|---|---|
| CA | 2962171 | A1 | 5/2017 |
| CH | 358204 | A | 11/1961 |
| CH | 404109 | A | 12/1965 |
| CN | 2082995 | U | 8/1991 |
| CN | 102356961 | A | 2/2012 |
| CN | 208286723 | U | 12/2018 |
| CN | 109875304 | A | 6/2019 |
| DE | 3805206 | C1 | 12/1988 |
| DE | 29717573 | U1 | 1/1998 |
| DE | 102005054321 | A1 | 5/2007 |
| EM | 000288287-0002 | | 2/2005 |
| EM | 000460399-0003 | | 12/2005 |
| EM | 001128854-0008 | | 4/2009 |
| EM | 004557577-0010 | | 12/2017 |
| EM | 008051254-0001 | | 7/2020 |
| EM | 008054852-0001 | | 7/2020 |
| EP | 1192877 | A2 | 4/2002 |
| EP | 2366310 | B1 | 10/2012 |
| FR | 1383394 | A | 12/1964 |
| GB | 876909 | | 9/1961 |
| TW | I463960 | B | 12/2014 |
| WO | 9808425 | A1 | 3/1998 |
| WO | 03096845 | A1 | 11/2003 |
| WO | 2007109699 | A2 | 9/2007 |
| WO | 2012060462 | A1 | 5/2012 |
| WO | 2013180213 | A1 | 12/2013 |

OTHER PUBLICATIONS

Written Opinion of International Application No. PCT/US2022/027475, dated Jul. 29, 2022, 4 pages.

* cited by examiner

CHAIR HAVING AN ACCESSORY HOOK

FIELD OF THE INVENTION

The present disclosure generally relates to structural configurations of a seating unit with a backrest, where that backrest may include a device for retaining accessory articles, such as a bag, jacket, whiteboard, or other item. More particularly, the present disclosure provides a seating unit including a hook assembly that secures to and protrudes outwardly from a backrest, the seating unit having a structural design that permits a compact, secure, and visually inconspicuous connection therebetween.

Additional considerations of the present disclosure relate to dynamic support structures for seating units. Specifically, some embodiments for seating units of the disclosure include a backrest that is dynamically connected to a seat via an intermediate support member. The support member is configured to permit rearward deflection of the backrest in response to forces applied by the back of a user, and a horizontal portion of the support member extends beneath the seat and is shaped to provide a load distribution function.

BACKGROUND

The need for learning is a fundamental rule of business, and a critical element of success. In an information age, effective, technology-driven learning is required not only in school, but also on the job. In part, effective learning depends on an environment which promotes interaction and collaboration with other students or coworkers and accommodates the use or storage of multimedia technology. As new interactive technologies and multimedia training programs emerge, the use of seating designed to support the necessary amount of collaboration and self-direction is important. For example, it has been recognized that relatively small whiteboards can be used in a classroom setting for expressing individual and small group thoughts to facilitate various types of learning activities. However, traditional seating options are often not equipped with means for conveniently storing or displaying such accessories.

Traditional classrooms, lecture halls, auditoriums, and meeting rooms often provide comfortable seating that allows individuals to concentrate and take notes. However, traditional seating options are not sufficiently flexible to adapt to a variety of seating arrangements that foster interactions required for group learning, and they also do not provide storage and easy access to personal belongings. Whether they are using or storing a whiteboard, backpack, computer, briefcase, purse, etc., people want their belongings to accompany them and be readily accessible.

A number of known seating units for classrooms include bins or wireframe racks disposed beneath the seat and being provided to accommodate the storage of accessory articles or extraneous classroom materials. Such bins have a relatively limited storage capacity and are therefore typically not able to retain bulkier items, like backpacks or jackets, with the chair. To the extent that such bins permit article storage, their configuration may not permit quick or easy access to the articles, e.g., to remove a book from a backpack, particularly if seats are positioned close to one another, thereby limiting a user's comfortable range of motion. Further, such bins are not configured to provide stored items with a high degree of visibility from the perspective of individuals throughout classroom. Seating units including storage bins beneath the seat also are typically incapable of being stacked due to the obstruction provided by the bin.

Some known seating units provide alternate devices for retaining accessories with the backrest of a chair in the form of a hook (or hook assembly) attached to the backrest, wherein accessory articles may be suspended from the hook. For example, Canadian Patent No. 2,962,171 discloses a garment hanger that is clampably mounted upon an upper edge of the backrest of a chair, and U.S. Pat. No. 10,219,631 discloses a chair having a backrest-mounted hook that is movable between extended and retracted positions. However, hook structures known in the prior art have deficiencies that stand to be improved.

A first type of known hook assembly for a chair removably attaches (i.e., clamps) upon a rear surface or upper edge of the backrest. Many users find the assembly of such structures to be cumbersome. Additionally, the associated mounting structures can mar the chair's exterior surfaces, and the hook assembly, itself, can often detract from the chair's aesthetic design.

Another known hook assembly for a chair securely couples to the backrest using threaded fasteners inserted horizontally into the rear surface of the backrest. Unfortunately, the practical implementation of such hook assemblies is limited to chairs having relatively bulky backrests that are thick enough to accommodate an inserted fastener without protrusion through the opposing (occupant-facing) surface. Also, a fastener that is over-inserted during assembly could crack, split, or otherwise damage the backrest.

Alternatively, some chairs include hook structures that are integrally formed with the backrest, but these structures cannot be replaced if damaged during use, short of replacing the entire backrest.

Seating must also be comfortable for persons of different sizes and accommodate a range of seated postures. In recent years, there has been a large amount of research surrounding the health benefits of maintaining good posture, especially while remaining seated for prolonged periods of time.

Generally, conventional adjustable seating includes a seat and a pivotally attached backrest which can be reclined, as desired. The recline feature is usually spring-biased up to a hard stop so that when selected, the user may lean back against the backrest and gently recline, continuously supported by the spring-bias, up to the hard stop. How far back the backrest reclines (i.e., the angular location of the hard stop) is usually adjustable from a vertical position (or approximately vertical), where the user does not want the backrest to recline at all and prefers to have full support when he or she leans back (sitting up straight).

Thus, a seating unit which provides one or more of comfort, convenience, durability, and flexibility in learning and collaborating environments is desired.

BRIEF SUMMARY OF THE DISCLOSURE

It is a primary object of the present disclosure to overcome one or more of the deficiencies of the prior art.

In one aspect, the present disclosure provides a seating unit comprising a backrest extending substantially vertically above a seat and attached to the seat by an intermediate support member. The backrest includes an outwardly protruding rim formed integrally with a rear surface, and a hook assembly is configured to securely couple with the backrest at the rim.

In another aspect, a seating unit comprises a backrest having a rim extending outward from a rear surface, and a hook assembly is configured to be securely coupled to the rear surface of the backrest at an attachment region, and the attachment region is at least partially circumscribed by the rim.

In another aspect, the hook assembly comprises a cover plate, a hook, and a weldment, all of which are configured to securely couple with the rear surface of the backrest at an outwardly protruding rim or within an attachment area being at least partially circumscribed by the rim. When coupled with the backrest, the weldment is disposed between the cover plate and the rear surface, and the hook assembly is configured to allow accessory articles to be retained with the backrest.

In still another aspect, a seating unit includes a backrest and a hook assembly. The hook assembly comprises a cover plate, a hook, and a weldment, wherein the hook is formed integrally with the cover plate and extends generally outward and upward from an exterior surface thereof, and the hook assembly is configured to allow accessory articles to be retained with the backrest.

In yet another aspect, the hook assembly comprises a cover plate, a hook, and a weldment, wherein the hook is materially distinct and separate from the cover plate. In such cases, the hook may include a first portion disposed between the weldment and the rear surface, a second portion extending below a bottom surface of the cover plate, and a third portion extending upwards from the second portion and being spaced apart from an exterior surface of the cover plate.

A secure coupling may be formed between the hook assembly and the backrest via insertion of a fastener substantially vertically through coaxially aligned apertures disposed on one-or-both of the hook assembly or the backrest. The fastener is inserted along a substantially vertical insertion axis, such that, following assembly, the body of the fastener is aligned substantially parallel to the rear surface of the backrest. The seating unit may be configured such that heads of substantially vertical fasteners are inset from a bottom surface of the hook assembly and thereby hidden from the line of sight of a user.

In some aspects, the hook assembly and backrest include cooperative mounting structures including a first mounting structure extending from the backrest, and a second mounting structure extending from the hook assembly. The cooperative mounting structures abut during assembly to facilitate proper alignment of the hook assembly upon the backrest.

The first mounting structure may include at least one rib formed integrally with and extending outward from a rear surface of a backrest, wherein the at least one rib is disposed within an attachment region being at least partially circumscribed by an outwardly protruding rim extending from the rear surface. The second mounting structure may include at least one protrusion formed integrally with and extending outward from an interior surface of the cover plate, and the at least one protrusion extends generally towards the rear surface of the backrest. During assembly, the at least one protrusion abuts against the at least one rib to facilitate proper alignment of the hook assembly upon the backrest.

In still another aspect, a seating unit comprises a hook assembly securely coupled to a rear surface of a backrest, wherein first and second mounting structures respectively extend from the backrest and the hook assembly and abut against one another to facilitate proper alignment of the hook assembly upon the backrest. The hook assembly comprises a cover plate and a weldment, wherein a secure coupling between the hook assembly and the backrest is formed via insertion of fastener along a substantially vertical insertion axis. Following insertion, the fastener body is aligned substantially parallel to a rear surface of the backrest, and the fastener extends through coaxially aligned apertures on the cover plate and weldment.

In yet another aspect, a seating unit comprises a backrest and a hook assembly that is securely coupled to a rear surface of a backrest. First and second mounting structures respectively extend from the rear surface of backrest and an interior surface of the hook assembly, wherein the second mounting structure abuts against a planar upper surface of the first mounting structure during assembly. The hook assembly may be pivotably mounted upon the rear surface. Further, a fastener extending through an aperture in the hook assembly is aligned substantially parallel with the rear surface.

In a further aspect, a seating unit comprises a backrest and a hook assembly. The backrest includes first mounting structure comprising a rib having a substantially L-shaped cross section, wherein a gap is formed between the rib and the rear surface. During assembly, a portion of the hook assembly is slotted with the gap formed between the rib and a rear surface of the backrest.

The following description and annexed drawings set forth in detail certain illustrative aspects of the present invention. These aspects are indicative, however, of but a few of the various ways in which the principles of the invention may be employed. Other advantages and novel features will become apparent from the following detailed description when considered in conjunction with the drawings.

BRIEF DESCRIPTION OF THE DRAWINGS

The invention will hereafter be described with reference to the accompanying drawings, wherein like reference numerals denote like elements, and.

DETAILED DESCRIPTION OF THE DISCLOSURE

One or more specific embodiments of the present invention will be described below. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
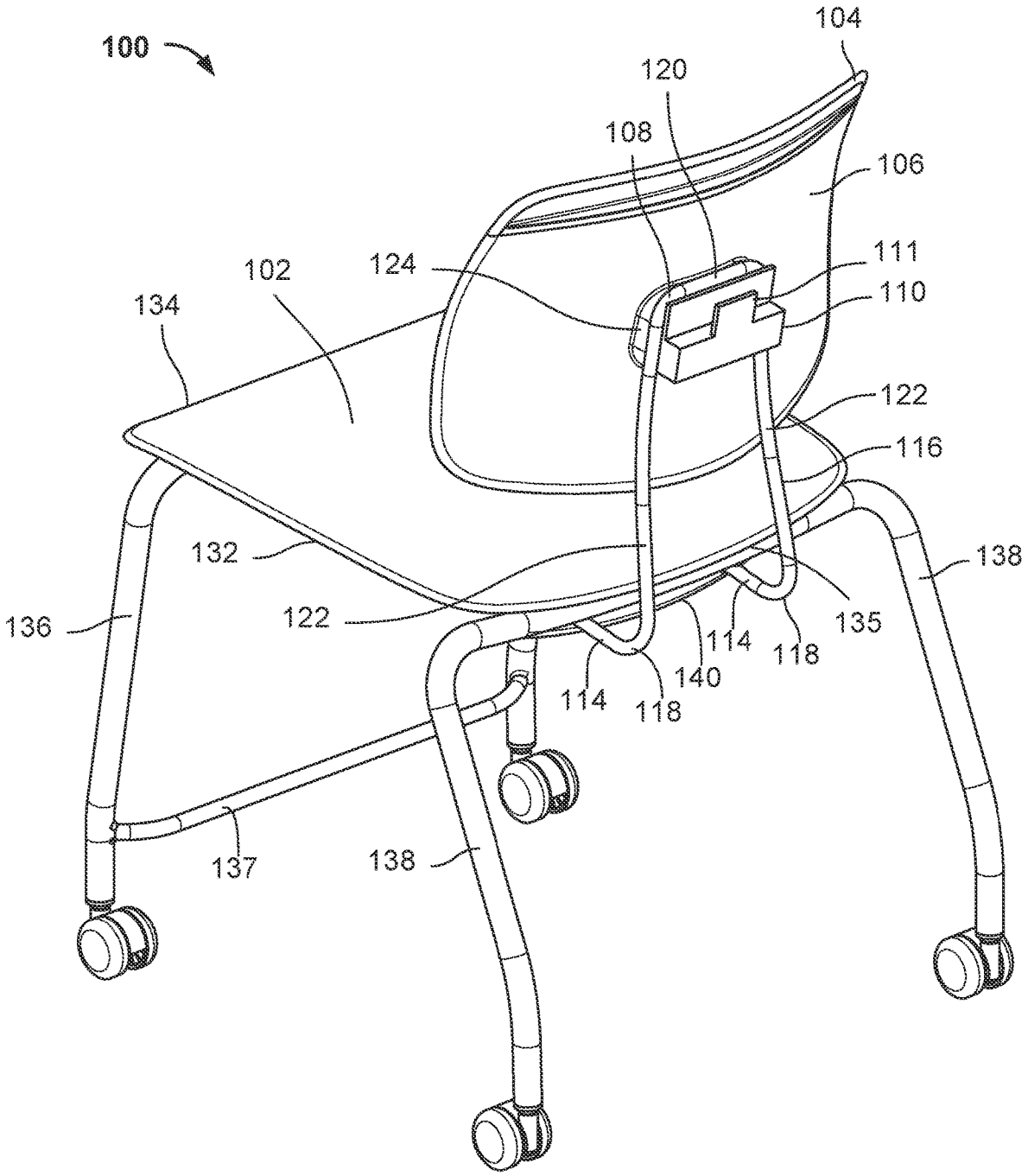
FIG. 1 is a rear perspective view of a seating unit comprising a chair that includes various features that are consistent with at least some aspects of the present disclosure.

For purposes of description herein, the terms "rear," "front," "vertical," "horizontal," and derivatives thereof shall relate to the seating unit as oriented in FIG. 1. However, it is to be understood that the seating unit may assume various alternative orientations, except where expressly specified to the contrary. It is also to be understood that the specific devices illustrated in the attached drawings and described below are simply exemplary embodiments of the invented concepts. Hence, specific dimensions and other physical characteristics relating to the embodiments disclosed herein are not to be considered as limiting.

Further, the term "substantially parallel," as used within the context of this disclosure, describes the general angular relationship between two structures extending largely in the same direction. This inclusion of this term should therefore not be interpreted as being limiting exclusively to objects that are geometrically parallel. Instead, it is contemplated that an angular displacement of up to ±12° could exist between any two objects described herein to be "substantially parallel." Further, the term could also apply to structures extending largely in the same direction that do not intersect and pass through one another.

Some seating units produced in accordance with the present disclosure comprise a backrest and a hook assembly being secured to, and protruding outward from, a rear surface of the backrest. Although the present disclosure is thought to encompass a wide variety structural configurations, exemplary hook assemblies produced in accordance with the present disclosure are, owing in part to the constructional form of cooperative mounting structures extending therebetween, adapted to unostentatiously couple with the backrest using hidden fasteners inserted substantially parallel to the rear surface.

Additional aspects of the present disclosure may further relate to seating unit assemblies including an intermediate support member that extends between the backrest and a seat, provides dynamic support for backrest, and includes shaped arms extending beneath the seat to perform a load distribution function.

Hook Assemblies

Referring now to the drawings, wherein like reference numbers correspond to similar elements throughout the several views, and, more specifically, referring to FIGS. 1-3, 8-12 and 18, at least some aspects of the present disclosure will be described in the context of an exemplary seating units 100 and 200, each seating unit including a seat 102 and a backrest 104. A vast majority of elements described below in reference to seating unit 100 also apply to seating unit 200. However, with particular reference to FIG. 12, seating unit 200 includes a base 156 and rear legs 138 which differ from those of seating unit 100. Otherwise, the vast majority of features described in the context of seating unit 100 are also applicable to seating unit 200.

Many novel aspects of the present disclosure are described in the context of exemplary of hook assemblies 110, 210, 310, and 410, which are primarily shown in FIGS. 4-7 and 13-15.

The exemplary hook assemblies 110, 210, 310, and 410 shown in FIGS. 4-7 are configured to securely couple to a rear surface 106 of the backrest 104 in order to retain accessory items, such as a bag, a whiteboard, or another item, with the backrest 104.

Each exemplary hook assembly 110, 210, 310, or 410 is configured to couple with the backrest 104 at an attachment region 126, 226, or 326. With reference to FIGS. 4-7, the aforementioned attachment regions are each defined as being an area on the rear surface 106 that includes at least one first mounting structure (hereinafter "rib") extending outwardly from the surrounding surface and being configured to abut against a second mounting structure (hereinafter "protrusion") on the hook assembly to facilitate its alignment on the backrest 104 during assembly.

Referring again to FIGS. 1-4, the seating unit 100 comprises the backrest 104 having a rear surface 106, and the hook assembly 110 (including a cover plate 111) is secured to the rear surface 106. A rim 124 protrudes outwardly from the rear surface 106 and is, preferably, formed integrally therewith, such that the rim 124 and backrest 104 may be formed together during an initial manufacturing process and may be materially indistinct components.

The hook assembly 110 includes a cover plate 111 having an integrally formed hook 115 extending generally outward and upward from an exterior surface 165 of the cover plate 111. An interior surface 113 of the cover plate 110, being disposed opposite the exterior surface 165, is secured to the backrest 104 at the attachment region 126 located proximate the rim 124. With specific reference to FIG. 4, the attachment region 126 may be more precisely defined as being the area circumscribed by the rim 124 and including ribs 154.

Some seating units produced in accordance with the present disclosure may not necessarily include one or more portions of the outwardly protruding rim 124. For example, in FIG. 5, the rim 124 does not bound a bottom boarder of the attachment region 226. However, the rim 124 bounds three sides of the attachment region 226 and is considered to partially circumscribe the region 226. Although not shown in the accompanying figures, some seating units in accordance with the present disclosure may include a rim comprising a plurality of discrete rim segments, which collectively create a discontinuous boundary that may at least partially circumscribe the attachment region.

Returning to FIG. 4, the ribs 154 extend outward from the rear surface 106 within attachment region 126, and the ribs 154 are preferably formed integrally with the backrest 104. The ribs 154 ribs each include a substantially flat planar surface that vertically abuts against a protrusion 148. The protrusions 148 extend from the interior surface 113 of the cover plate 111, and the abutment of the ribs 154 against the protrusions 148 facilitates proper alignment of the hook assembly 110 with the backrest 106 during assembly.

Figure 4:
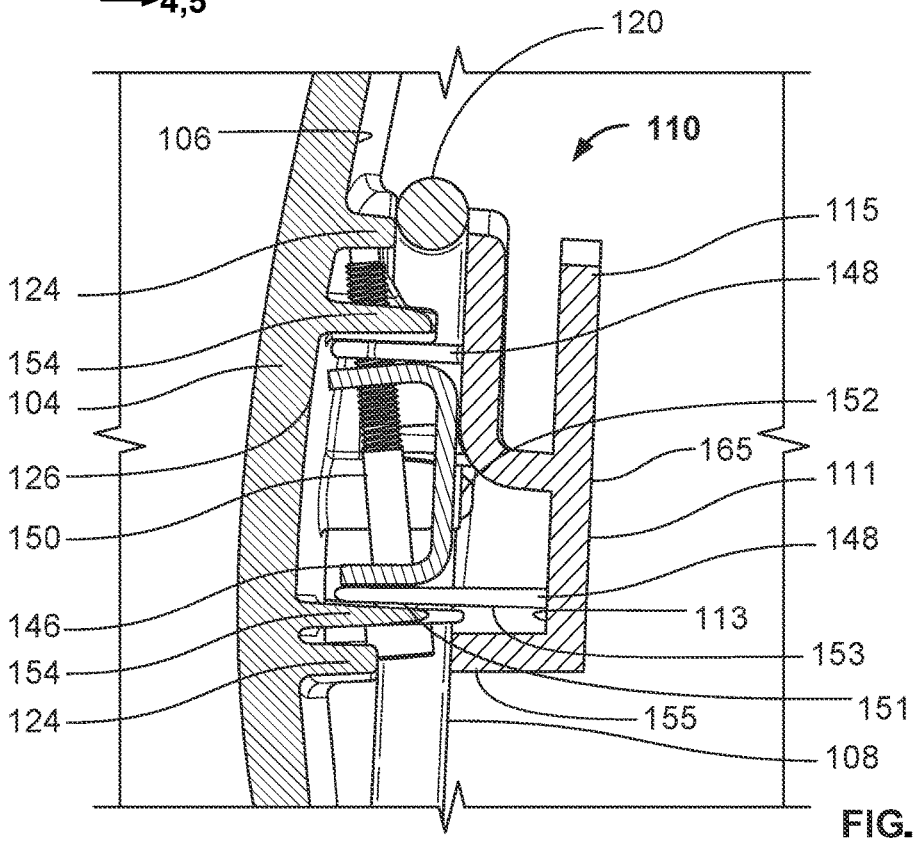
FIG. 4 is a cross-sectional, detail view through line 4-4 in FIG. 3, showing a seating unit having a hook assembly and associated mounting interfaces in accordance with a first embodiment.
Figure 13:
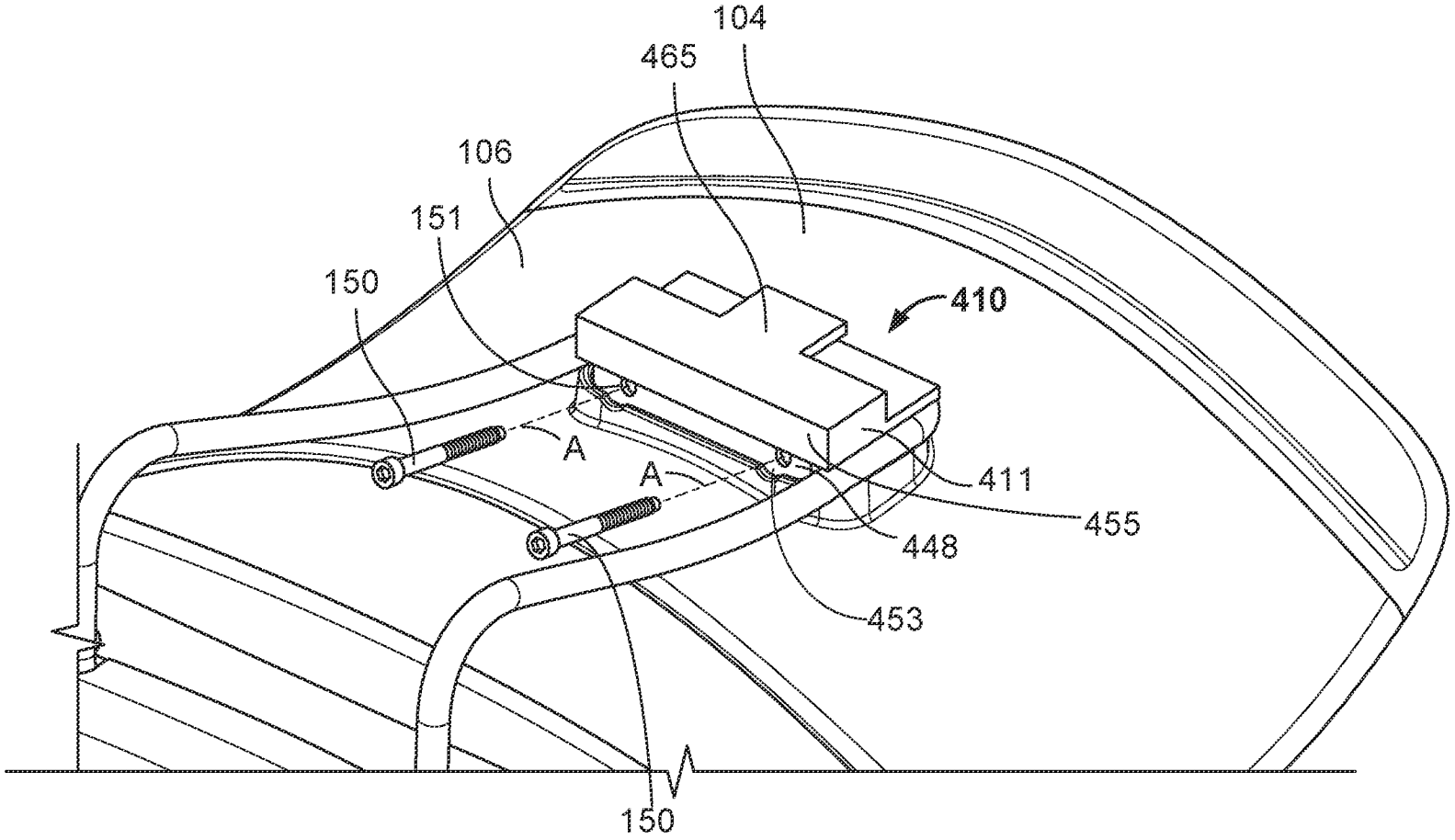
FIG. 13 is an enlarged, partially assembled view of a chair assembly in accordance with any of the aforementioned embodiments, wherein the hook assembly is secured to the backrest via fasteners that are inserted parallel to a backrest.
Figure 14:
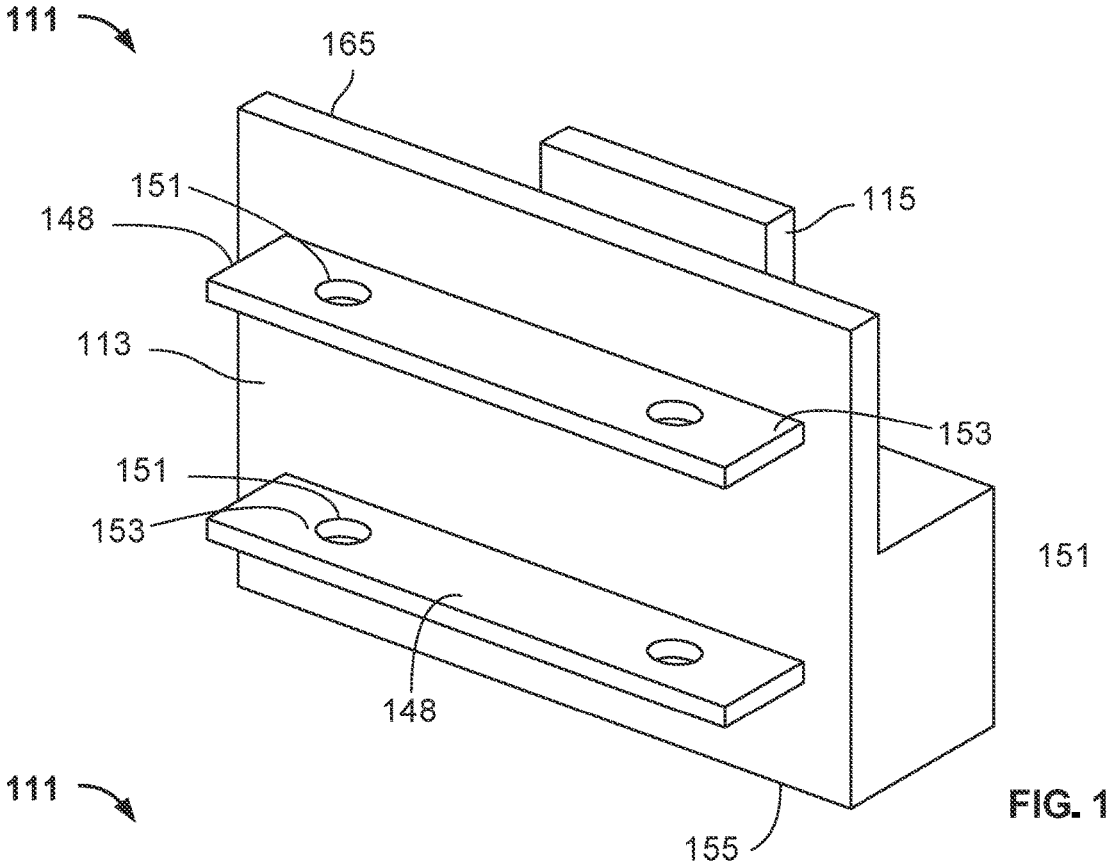
FIG. 14 is an enlarged, perspective view showing an interior side of a cover plate for an accessory hook assembly.
Figure 15:
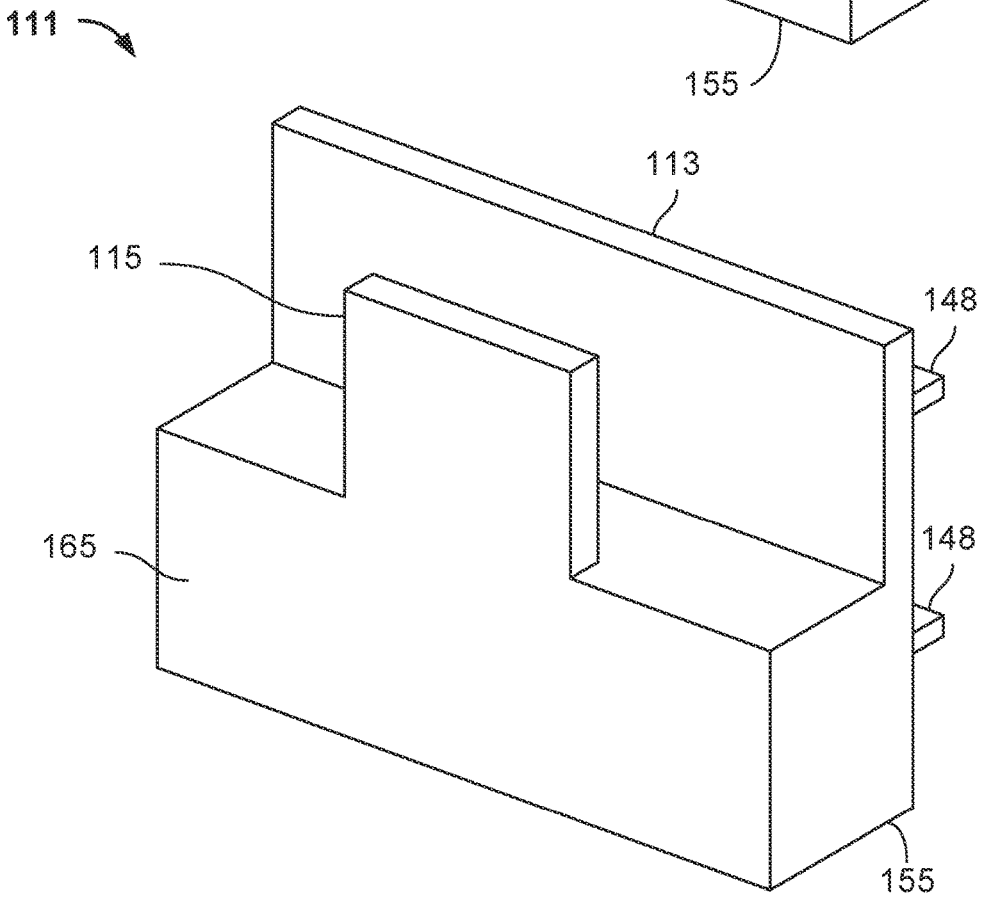
FIG. 15 is an enlarged, perspective view showing an exterior side of the cover plate of FIG. 14.

The cover plate 111 of FIG. 4 securely couples with the backrest 104 at the attachment region 126 following the insertion of one or more fasteners 150 substantially vertically through complementary apertures 151 being defined on the substantially flat, planar surfaces 153 of protrusions 148, which are also shown in FIG. 14. Referring to FIG. 13, the fastener 150 is inserted through the aperture 151 along a substantially vertical axis "A", and, following insertion, the body of the fastener 150 is aligned substantially parallel with the rear surface 106. Advantageously, the substantially vertical insertion of the fasteners 150 or 250 allows for the heads of the fasteners 150 or 250 to be easily hidden in a recessed area behind the exterior face 165.

The hook assemblies 110, 210, 310, and 410, shown in FIGS. 4-7, are configured to securely attach to the backrest 104 at the outwardly protruding rim 124 and/or within the attachment regions 126, 226, or 326, which may be at least partially circumscribed by the outwardly protruding rim 124 and include at least one rib 154, 254, or 354.

Figure 16:
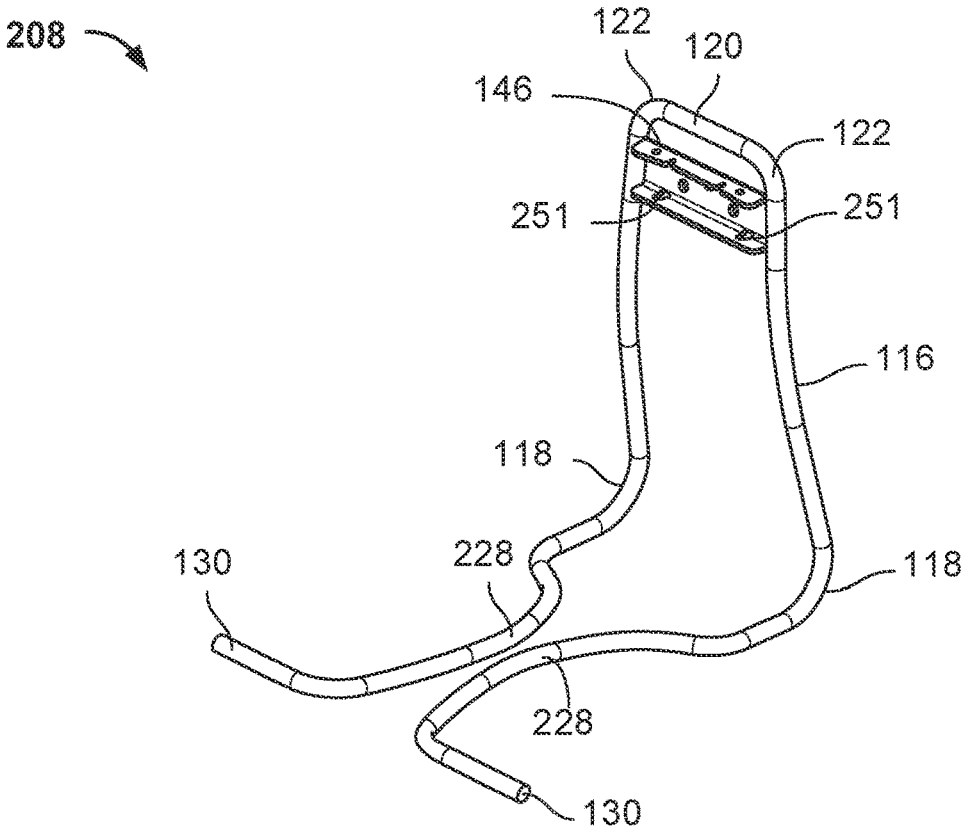
FIG. 16 is a perspective view showing an alternate embodiment for a support member of a seating unit, the support member having horizontally extending arms, as well as a weldment coupled to a vertical portion.
Figure 17:
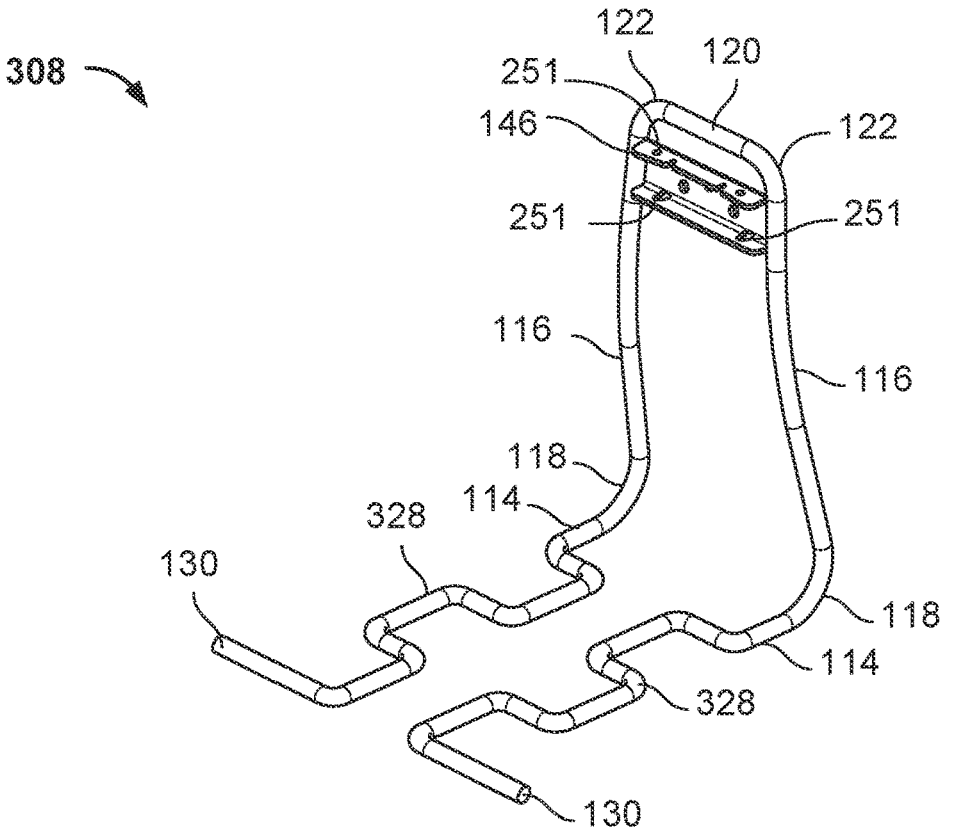
FIG. 17 is a perspective view showing another alternate embodiment for a support member of a seating unit having horizontally extending arms, as well as a weldment is coupled to the vertical portion.

The hook assemblies 110, 210, 310, and 410 each comprise a weldment 146, 246, or 346 and a cover plate 111, 211, 311, or 411. Although shown as separate components in FIGS. 9-11, it should be understood that the weldment is permanently affixed, e.g., by welding, to a support member 108, 208, or 308. For example, as seen in FIGS. 16 and 17, the weldment 146 is secured to opposing interior sides of vertical arms 122 in an upright portion 116 of the support member 108, proximate an upper loop 120 of the support member 108. The weldment 146, 246, or 346 is secured to the backrest 104 using a horizontally inserted fastener 152 prior to attachment of the cover plate 111, 211, 311, or 411, and the weldment 146, 246, or 346 is interposed between the cover plate 111, 211, 311, or 411 and the rear surface 106 following assembly. As such, when the hook assembly 110 is secured to the backrest 104 overtop the weldment 146, as shown in FIG. 4, the support member 108 is likewise secured to the backrest 104.

Figure 5:
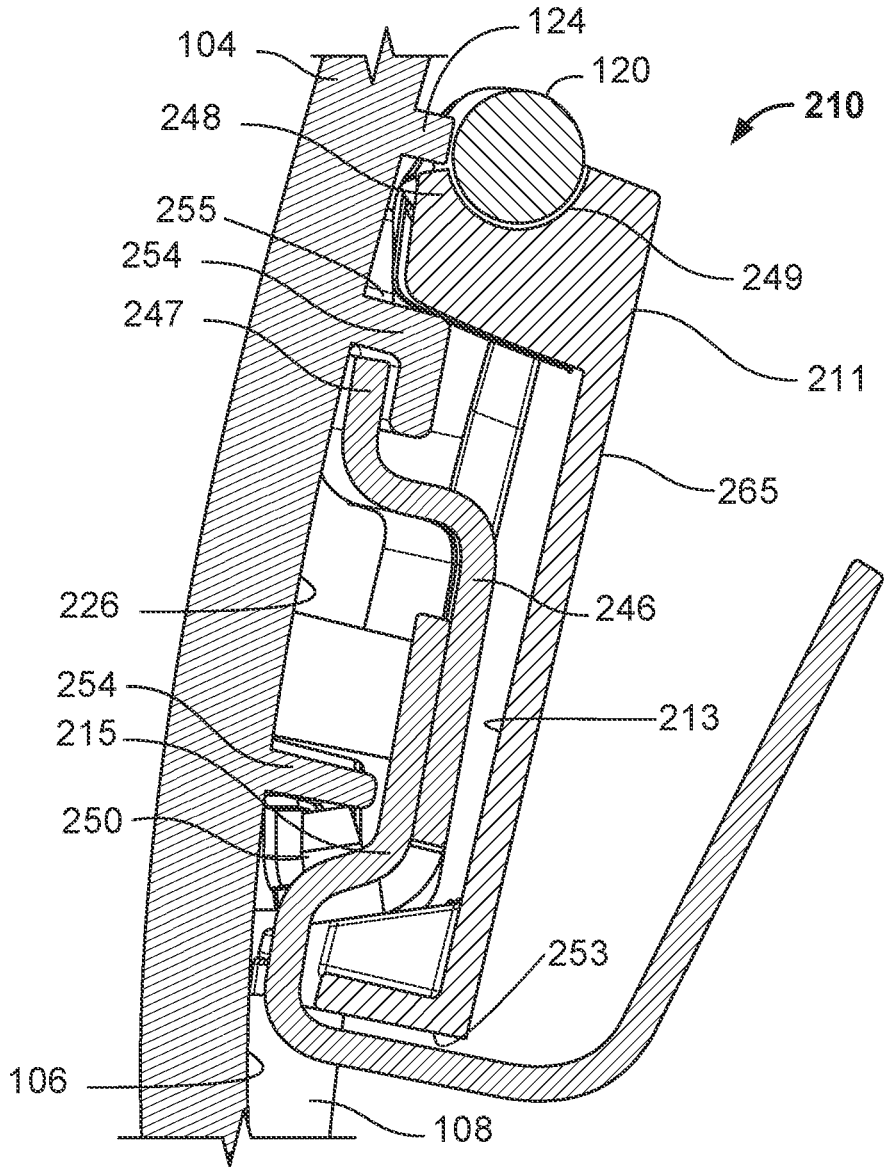
FIG. 5 is a cross-sectional, detail view showing a chair having a hook assembly and associated mounting interfaces in accordance with a second embodiment.
Figure 7:
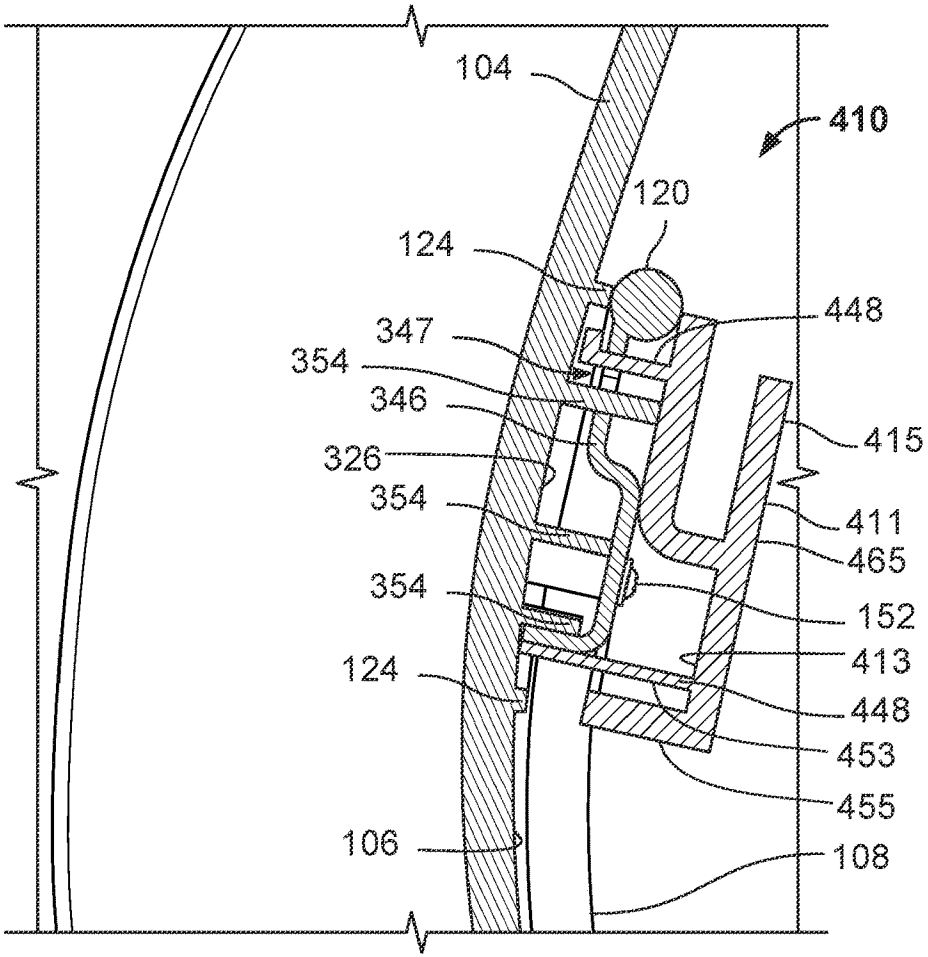
FIG. 7 is cross-sectional, detail view of a hook assembly with mounting interfaces and associated structures of a third embodiment, taken through a line equivalent to the line 7-7 in FIG. 3.
Figure 6:
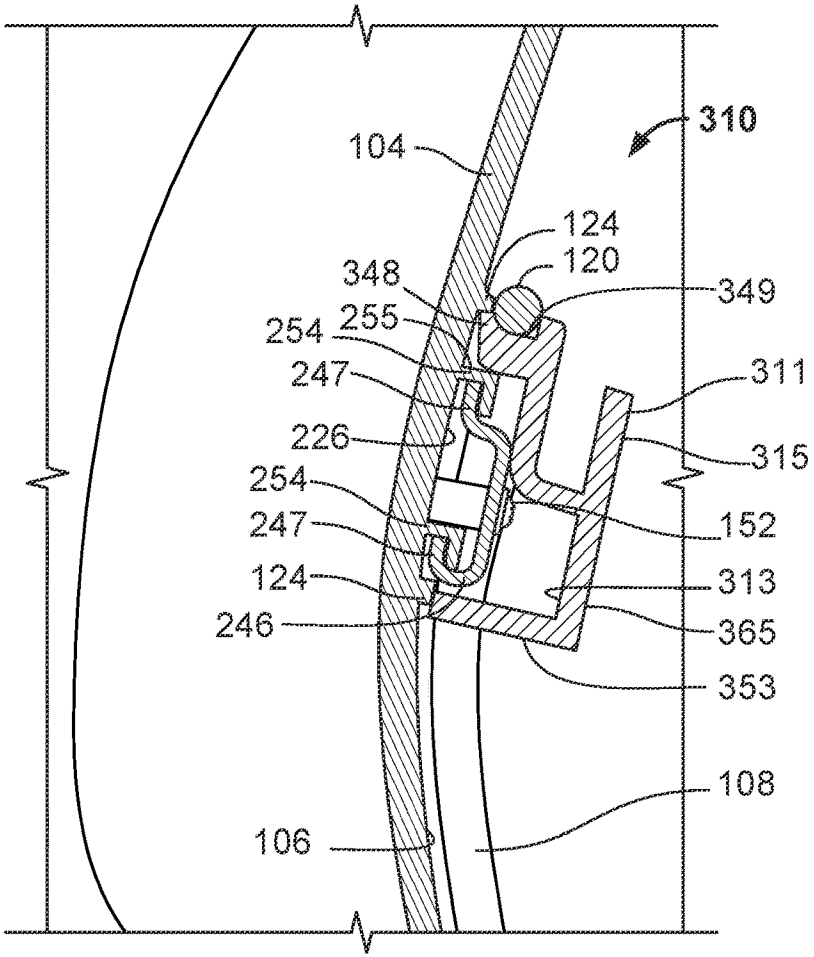
FIG. 6 is cross-sectional, detail view of a hook assembly with mounting interfaces and associated structures of the second embodiment, taken through a line equivalent to the line 6-6 in FIG. 3.

With reference to FIGS. 5-7, alternate examples of hook assemblies 210, 310, and 410 are shown in connection with the backrest 104. Each includes at least one protrusion 248, 348, or 448 extending from an interior surface 213, 313, or 413 of a cover plate 211, 311, or 411 and directed generally towards the backrest 104. The at least one protrusion 248, 348, or 448 abuts against a planar surface of a rib 254 or 354 to facilitate proper alignment of the cover plate 211, 311, or 411 with the backrest 104. An aperture 151 is defined through a planar surface 253, 353, or 453 of the cover plate 211, 311, or 411, and a fastener 150 or 250 is inserted substantially vertically through the aperture 151 to couple the hook assembly 110 with the backrest 104. After insertion, the body of the fastener 150 or 250 is aligned substantially parallel with the rear surface 106 in the area proximate aperture 151, and the heads of the fasteners 150 or 250 are disposed along the planar surface 253, 353, or 453, hidden from the line of sight of a user sitting or standing behind the chair.

Figure 10:
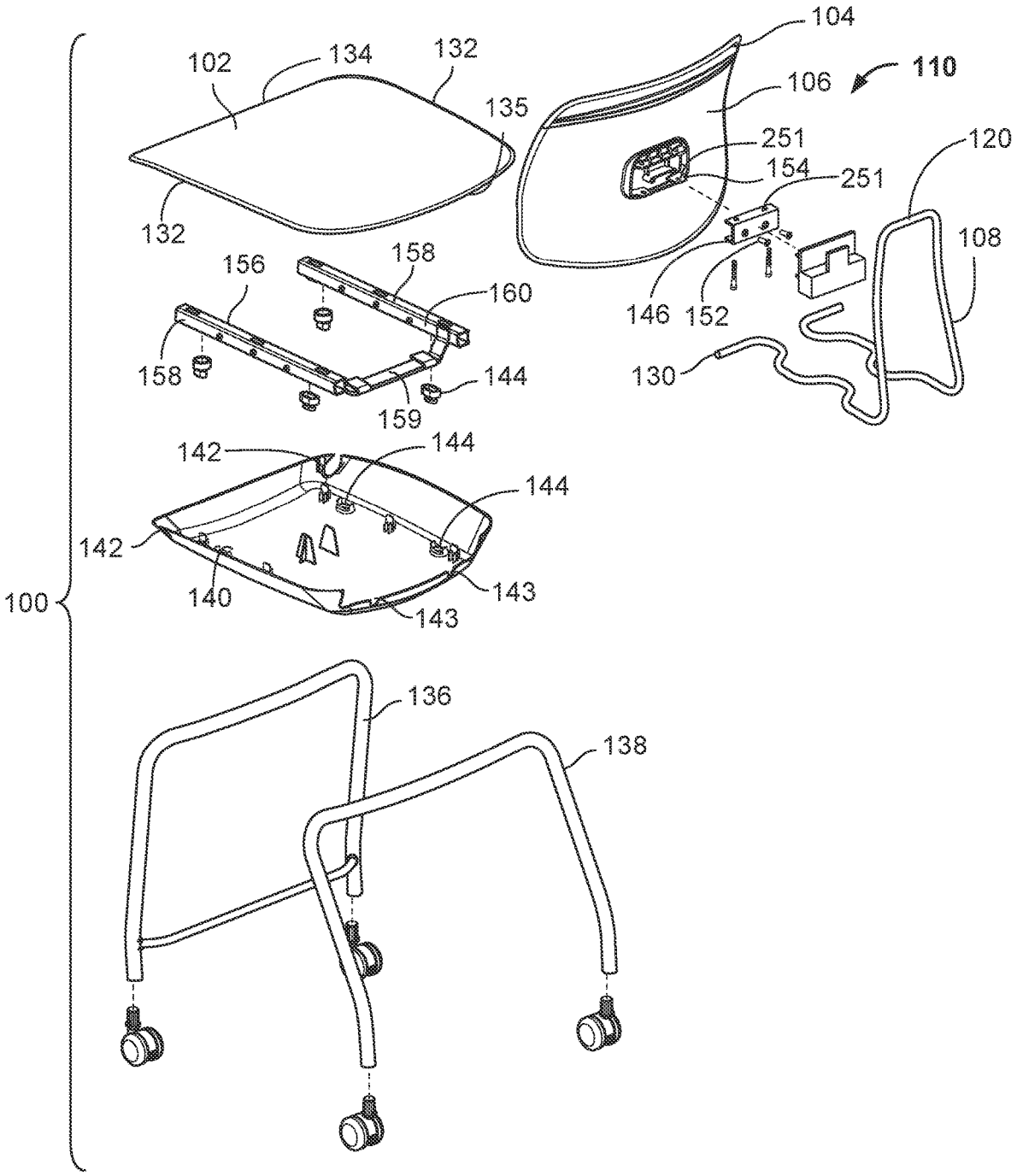
FIG. 10 shows the exploded chair assembly of FIG. 9 when viewed from a rear, top, and left side perspective.

In many embodiments, proper alignment of the cover plate 111 within the attachment region 126 causes aperture 151 to align coaxially with one or more apertures 251 being defined upon either or both of the weldment 146 or the rib 154. Referring collectively to FIGS. 4, 10, and 14 the fastener 150 is inserted vertically through the apertures 151 and coaxially aligned apertures 251 (shown in FIG. 10) in each of the weldment 146 and the rib 154.

With reference to FIGS. 4-7, the mounting structures (i.e., ribs 154, 254, and 354 and protrusions 148, 248, 348, and 448) may be formed in a variety of different shapes. For example, the mounting structures may be generally C-shaped or U-shaped with arms that are generally parallel to one another, or with one arm inclined inward a greater degree than the other arm, or with one arm angled outward and away from the first arm, e.g., so as to be generally parallel to a base portion connecting the two arms. Similarly, the ribs may comprise planar ribs 154 (as seen in FIG. 4), L-shaped ribs 254 (as seen in FIG. 6), or other shapes different from the examples shown and described herein.

Likewise, the protrusions 148, 248, 348, or 448 extending from the interior surfaces 113, 213, 313, or 413 of the exemplary hook assemblies may comprise planar protrusions 148 (as seen in FIG. 4), curved protrusions 248 or 348 (as seen in FIG. 5 or 6), hooked protrusions 448 (as seen in FIG. 7), or other shapes different than those explicitly shown and described herein.

Although not shown in FIGS. 6 and 7, all embodiments of cover plates in accordance with the present disclosure are configured to secure to a backrest via insertion of one or more fasteners 150 or 250 that are aligned substantially parallel to the rear surface 106 of the backrest.

Referring to FIG. 5, the hook assembly 210 comprises cover plate 211, weldment 246, and hook 215. Unlike the embodiment of FIG. 4, the hook 215 comprises its own component and is separate from (i.e., not integrally formed with) the cover plate 211. The hook 215 is generally U-shaped having two upwardly extending arms joined by an arcuate portion. An upper rib 254 protrudes from the rear surface 106 of the backrest 104 and is generally L-shaped, having a first, planar upper arm extending outward from the rear surface 106 and a second, planar arm extending generally perpendicular from a distal end of the first arm opposite the rear surface 106, wherein a gap is formed between the second arm of the upper rib 254 and the rear surface 106, and a portion 247 of the weldment 246 is slotted into the gap during assembly. A planar upper surface 255 of the first arm of the upper rib 254 is configured to abut against the protrusion 248. The protrusion 248 may include a concave upper surface 249, and the upper loop 120 of the support member 108 may be seated within the concave upper surface 249.

The process of attaching the hook assembly 210 to the attachment region 226 of the backrest 104 first involves sliding the weldment 246 vertically upward or the seat back downward until portion 247 slots within the gap formed between the upper rib 254 and the rear surface 106. Fastener 152 (not visible in FIG. 5) may be inserted horizontally through the front face weldment 246 to secure the weldment to the backrest 104, similar to the way in which faster 152 is inserted within weldment 146 in FIGS. 4 and 10. The hook 215 is then passed vertically upward such that one of the arms is passed behind the weldment 246 (i.e., between the seat back and the weldment), and the cover plate 211 is rotationally (or pivotably) mounted on top of the weldment 246.

Rotational mounting of the cover plate 211 comprises placing the concave upper surface 249 of protrusion 248 against the upper loop 120 prior to pivotally rotating the cover plate 211 clockwise (with respect to FIG. 5) about a pivot axis being defined at the upper loop 120, such that the lower planar surface 253 is swung closer to the backrest 104. An aperture 151 (not shown in FIG. 5) on the planar surface 253 coaxially aligns with an aperture 251 on the weldment 246 when the cover plate is properly aligned, and one or more fasteners 250 is subsequently inserted substantially vertically through the coaxially aligned apertures 151, 251, in a fashion similar to the insertion of the one or more fasteners 150 in FIG. 4. Following assembly, one of the upwardly extending arms of the hook 215 is disposed between the weldment 246 and the rear surface 106, the arcuate portion of the hook 215 extends below the planar surface 253 of the cover plate 211, and the other arm extends upward and outward from the arcuate portion such that the hook 215 is spaced apart from an exterior surface 265 of the cover plate 211.

FIG. 6 is provided for the purpose of demonstrating how mounting interfaces and associated structures may vary along their length, and FIG. 6 further demonstrates how a variety of cover plates, e.g., 211 or 311, may be interchangeably coupled to the attachment region of a seating unit in accordance with the present disclosure.

FIGS. 5 and 6 respectively show hook assemblies 210 and 310 in which a weldment 246 is installed within the attachment region 226 prior to rotationally mounting the cover plate 211 or 311 on the backrest 104. The process for installing the weldment comprises slotting the weldment portion 247 into the gap formed between the rear surface 106 of the backrest and at least one of the L-shaped ribs 254, wherein the at least one L-shaped rib 254 holds the weldment portion 247 in close proximity to the rear surface 106 and prevents the weldment 246 from slipping out of the attachment region 226. When the cover plate 211 or 311 is rotationally mounted on top of the weldment 246, the cover plate protrusions 248 or 348 become wedged between the upper surface 255 of the rib 254 and the upper loop 120 of the support member 108, with the cover plate portions 248, 348 applying a compressive force to the L-shaped rib 254, thereby compressing the weldment portion 247 between the rear surface 106 of the backrest and the L-shaped rib 254. As such, the protrusions 248 and 348 abut against the rib 254 to structurally reinforce the attachment between the weldment 246 the backrest 104, preventing the weldment 246 from biasing the L-shaped rib 254 outward and slipping out of the attachment region 226. In some embodiments, rotationally and compressively mounting the cover plate on top of the rib 254 may, alone, provide enough structural reinforcement and/or compressive force to the rib 254 to securely couple the weldment 246 to the backrest 104. However, other embodiments may include additional or alternate means for fastening the weldment 246 to the backrest 104, including, e.g., the horizontal fastener 152 shown in FIG. 6.

More specifically, FIG. 6 shows another exemplary hook assembly 310, which includes a third embodiment for a cover plate 311 being mounted over-top the weldment 246 (of FIG. 5) and secured to the attachment region 226 (of FIG. 5). Comparatively, the cross-sectional view of FIG. 6 is taken through a plane generally corresponding with the location of line 6-6 of FIG. 3, whereas the cross-sectional view of FIG. 5 is taken through a plane generally corresponding with the location of line 5-5 of FIG. 3. Thus, the cross-sectional plane of FIG. 6 is shifted laterally with respect to the cross-sectional plane of FIG. 5, and hook assembly 310 includes cover plate 311 in place of cover plate 211.

Although not visible in the cross-sectional plane of FIG. 6, the hook assembly 310 is coupled to the backrest 104 by one or more threaded fasteners 150 or 250, like those which are shown in FIG. 4 or 5, being inserted substantially vertically through a planar lower surface 353 of the cover plate 311. Two L-shaped ribs 254 protrude outwardly from the rear surface 106 within the attachment region 226, and distal portions 247 of the weldment 246 slot within the gaps formed between the L-shaped ribs 254 and the rear surface 106. The cover plate 311 includes a protrusion 348 extending from the interior surface 313 proximate an upper edge, and the protrusion 348 includes a recessed upper surface 349 that allows the cover plate 311 to rotationally mounted overtop the weldment 246 in the same manner as was described for cover plate 211 of FIG. 5. The recessed upper surface 349 may be concave like that of FIG. 5, or the recess may be the form of a channel having a rectangular, triangular, trapezoidal, or other cross-section. The cover plate 311 further includes exterior surface 365 opposite the interior surface 313, and an integrally formed hook 315 extends generally upward and outward from the exterior surface 365.

Referring now to FIG. 7, in still another aspect, the hook assembly 410 comprises a cover plate 411 having an integral hook 415 extending generally outwards and upwards from exterior surface 465. The weldment 346 is integrally attached with (or welded to) the support member 108 at the upper loop 120. Thus, when the fastener 152 is used to secure the weldment 346 to attachment region 326, the support member 108 is also securely fastened to the backrest 104. The weldment 346 includes an opening 347 proximate the attachment to the upper loop 120, and an upper protrusion 448 extending from the interior surface 413 of the cover plate 411 passes through the opening 347 and latches upon an interior surface of the weldment 346. Although not shown in the cross section of FIG. 7, the hook assembly 410 is likewise configured to secure to the backrest 104 following receipt of one or more threaded fasteners 150 inserted substantially vertically through an aperture 151 defined upon the planar lower surface 453 of protrusion 448 and through coaxially aligned apertures in the weldment 346 and rib 354, similar to the configuration shown in FIGS. 4 and 10. Following insertion of the fastener 150, as shown in FIG. 13, the fastener 150 is aligned substantially parallel with the rear surface 106, and the head of the fastener 150 is inset from a bottom surface 455 of the cover plate 411 and hidden from view of a user.

Figure 9:
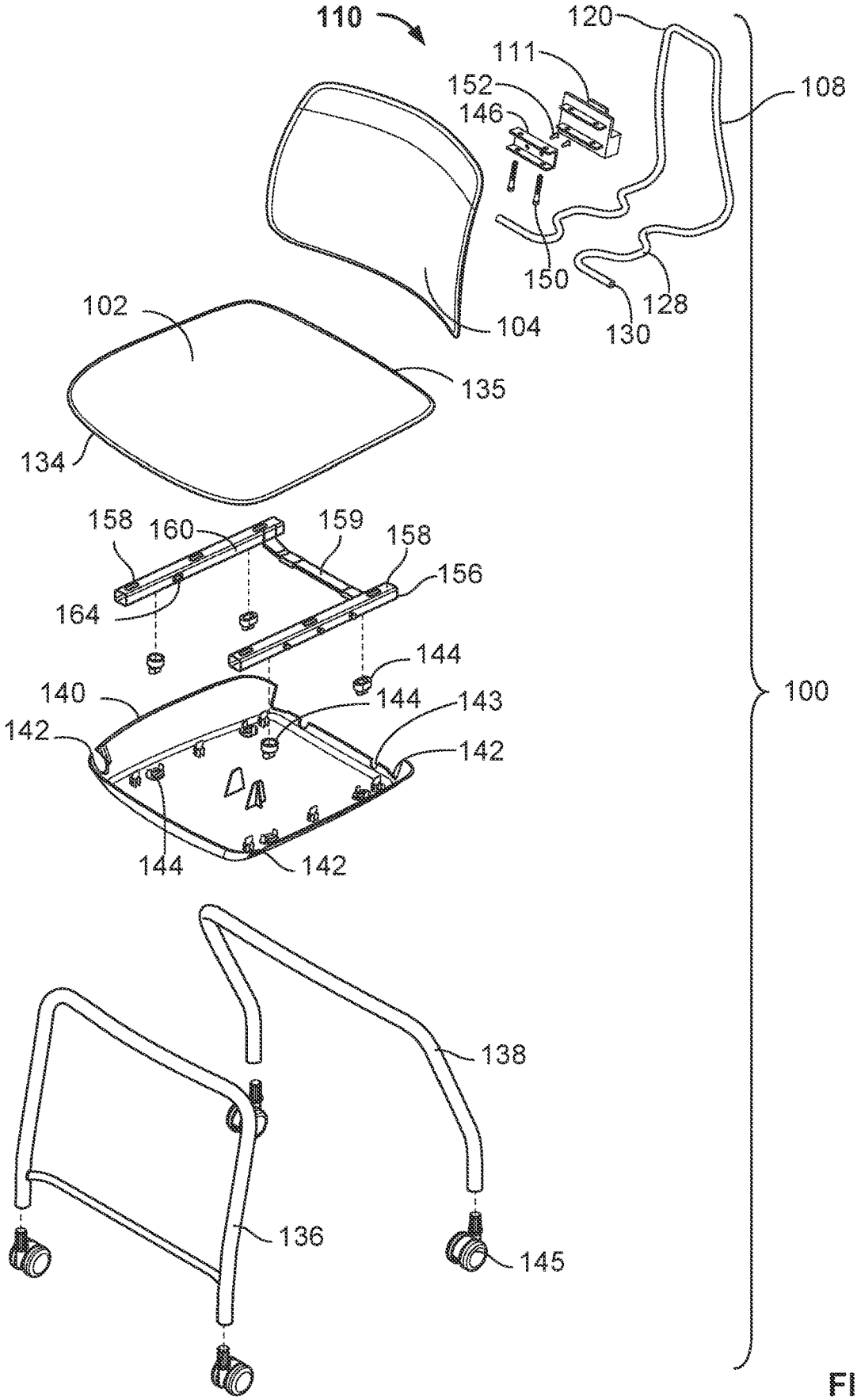
FIG. 9 is exploded view of the seating unit of FIG. 8 when viewed from a front, top, and left side perspective.
Figure 11:
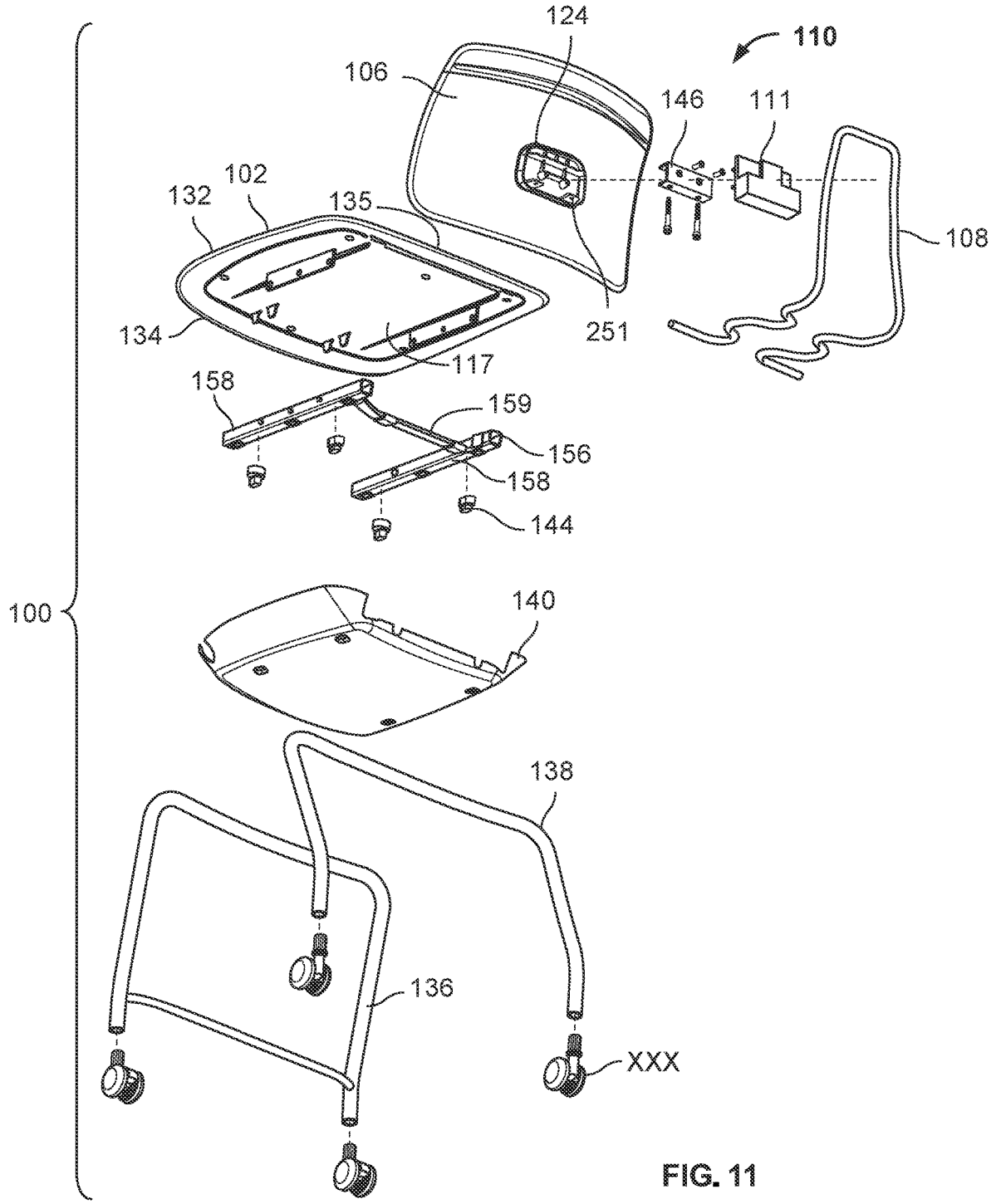
FIG. 11 shows the exploded chair assembly of FIG. 9 when viewed from a rear, bottom, and left side perspective.

In addition to the cross-sectional views of FIGS. 4-7, a number of exploded views of the seating unit 100 are provided in FIGS. 9-11, which show how the weldment 146 first is used to secure the support member 108 to the seat back 106 using the fasteners 152, and then the cover plate 111 is coupled (according to the methods described above) to the weldment 146 and/or the seat back 104 using the second fasteners 150.

Turning to FIG. 13, an underside of the hook and chair back subassemblies are depicted in order to better show how the hook assembly 410 of FIG. 7 is mounted upon the backrest 104, and fasteners 150 are used to securely couple the cover plate 411 to the backrest 104. The fasteners 150 are inserted along substantially vertical insertion axes "A" and pass through apertures 151 on the cover plate 411 during assembly. Specifically, the apertures 151 are disposed on the planar lower surface 453 of protrusion 448 and inset from the bottom surface 455. Following insertion, the heads of the fasteners 150 abut against the lower surface 453 of protrusion 448, and, being inset from the bottom surface 455, are hidden from the view of an observer standing behind the seating unit 100 and facing the rear surface 106. Accordingly, seating units of the present disclosure include a hook assembly and a backrest, wherein fasteners inserted substantially parallel to the rear surface of the backrest couple the hook assembly to the backrest, and the fasteners are hidden from the line of sight of a typical user. Although FIG. 13 depicts a configuration in which a pair of fasteners 150 are used to secure the cover plate 411 to the backrest 104, it will be appreciated that a single fastener may suffice to accomplish the desired coupling.

Seat and Backrest Support Structure

Figure 8:
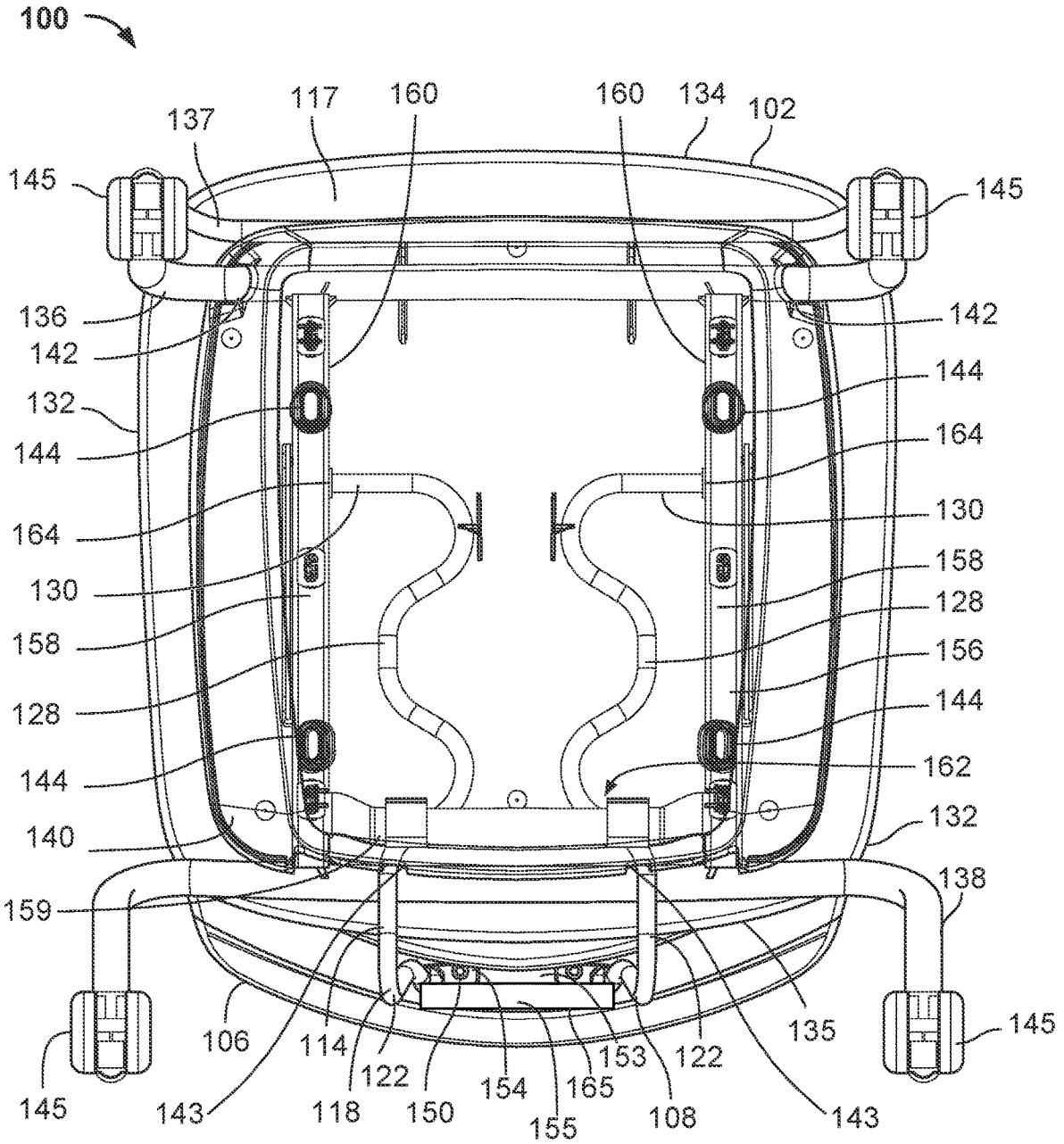
FIG. 8 is a bottom view of the chair shown in FIG. 1, wherein the exterior housing is drawn as being transparent so that various structures extending beneath the seat can be viewed.

Referring again to FIGS. 1-3, the backrest 104 is supported vertically above a rear edge 135 of the seat 102 by a flexible support member 108, which allows for a rearward, pivotal deflections of the backrest 104 to occur in response to forces applied to the backrest 104 by a user. Referring to FIGS. 1-3 and 8-12 collectively, the support member 108 includes a plurality of arms 122, each arm 122 including a horizontal portion 114 extending beneath the bottom surface 117 of the seat 102 with shaped portions 128 configured to provide a load-distribution function, the arms 122 having distal ends 130 secured within attachment locations 164 disposed on interior surfaces 160 of a frame 156 extending downward from an underside 117 of the seat 102, as shown in FIG. 8. Each arm 122 further includes an upright portion 116 for flexibly supporting the backrest 104, and a transition portion 118 extends curvilinearly upward from the horizontal portion 114 to join the horizontal portion 114 with the upright portion 116.

The support member 108 is generally formed from a single wire being bent in a way that forms two arms 122 joined at an upper loop 120 joining upper ends of the upright portions 116, where the upper loop 120 seats against the rim 124 extending from the rear surface 106 of the backrest 104, as discussed above.

The support member 108, 208 or 308 may be formed from high carbon steel or spring steel. In other embodiments the support member may be formed from another suitable material(s), such as, for example, aluminum, polyvinyl chloride (PVC), Acrylonitrile butadiene styrene (ABS), HDPE (high-density polyethylene), or bamboo, among others. Importantly, materials from which the support member 108 is manufactured should be flexible enough to allow for pivotal deflections to occur when a user leans against the backrest 104, and the material must also be strong enough to withstand typical loads applied to the seat 102 and backrest 104 by a user.

In one aspect, the support member 108 generally comprises a single tube or wireframe, which is generally cylindrical and may be formed from bent metal. With reference to FIG. 8, the horizontal portion 114 of each arm 122 extends curvilinearly beneath the seat 102, as discussed in greater detail below, thereby forming shaped portions 128 that may provide a load distribution function to permit the seat to accommodate a larger range of user weights.

The upper loop 120 may be secured to the backrest 104 in a wide variety of ways, as would be appreciated by those of ordinary skill in the relevant art, but in some embodiments, the weldment 146 of the hook assembly is welded in between the arms 122 in the upright portion 116 proximate the upper loop 120, as shown in FIGS. 16 and 17.

Figure 12:
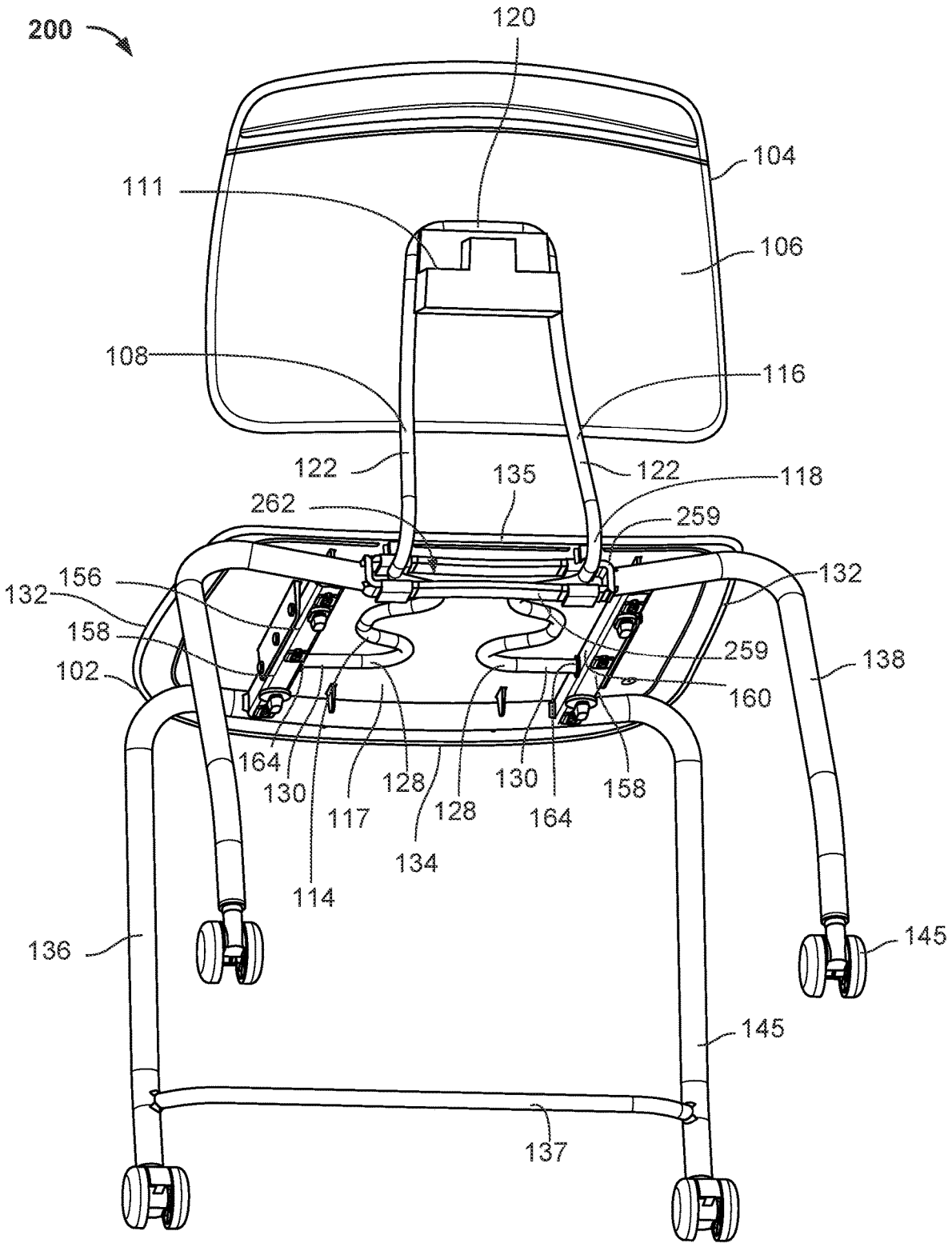
FIG. 12 is a rear, bottom, and left side perspective view of a chair in accordance with another embodiment of the present disclosure, wherein rear legs of the chair are integrally attached to the frame, and a portion of a backrest support member extends through a rectangular opening in the frame.

Referring to FIGS. 8 and 12, from the securing locations 164 at the distal ends 130, the two shaped arms 128 extend towards the rear edge 135 in parallel with the bottom surface 117 of the seat 102, and the shaped portions 128 comprise mirrored sinusoidal structures. That is to say, the shaped portions 128 remain parallel with the bottom surface 117 while extending curvilinearly reward in a periodic pattern of convergences toward- and divergences away from- a central longitudinal plane of the seat 102, and the two shaped portions 128 of the arms 122 structurally mirror one another about the central longitudinal plane.

The sinusoidal shape of each arm 122 may functionally increase the load-bearing capacity of the back shell or backrest 104 and/or to reduce stress concentrations in the distribution of force when a user pushes on the back shell 104. The winding path of the shaped portions 128 increases the overall surface area through which forces applied to the seat by a user are distributed, which may reduce average peak stress concentrations across the back shell body to mitigate wear, and increasing user comfortability by preventing the manifestation of high-pressure zones on the back shell's surface.

In the exemplary embodiments shown in FIGS. 8-12, the shaped portions 128 have a sinusoidal or serpentine structure that is mirrored about the central plane. In the preferred embodiments the bends between the undulations are preferably smooth and rounded to avoid sharp corner stress concentrations. However, alternate embodiments may include relatively sharper bends in the shaped portions 328, like those which are shown in support structure 308 of FIG. 17.

Still further, alternative embodiments for a support structure may include a horizontal portion 114 having shaped portions 128 that are configured differently that the exemplary embodiments shown in the figures. For example, the shaped portions 128 may have a greater or reduced periodicity (i.e., there may be fewer or more undulations along the length of shaped portions 128), or the shaped portions 128 may extend over and back across a central longitudinal plane, at least once, or the shaped arms may intersect one another. Referring to FIGS. 8 and 16, support structure 208 of FIG. 16 includes shaped portions 228 having a reduced periodicity relative to shaped portions 128 of the support structure 108 of FIG. 8. In other embodiments, the curvilinearly shaped portions 128 may be inverted across the central plane (as opposed to being mirrored), or the shaped portions 128 of the respective arms 122 may have a structure that is mirrored across a different plane or multiple planes.

Thus, the shape of the arms in the horizontal portion of the support structure may improve the dynamic performance of the chair, increase a seating unit's load bearing capacity, influence the backrest's flexibility, and/or improve load distribution across a back shell.

At the transition portions 118, the two arms 122 wrap curvilinearly around the rear side of the frame to join with the upright portions 116. When a user leans back into the backrest, the upright portions 116 of the support member 108 may be designed to rotate rearward until being impeded by a hard stop.

Figure 2:
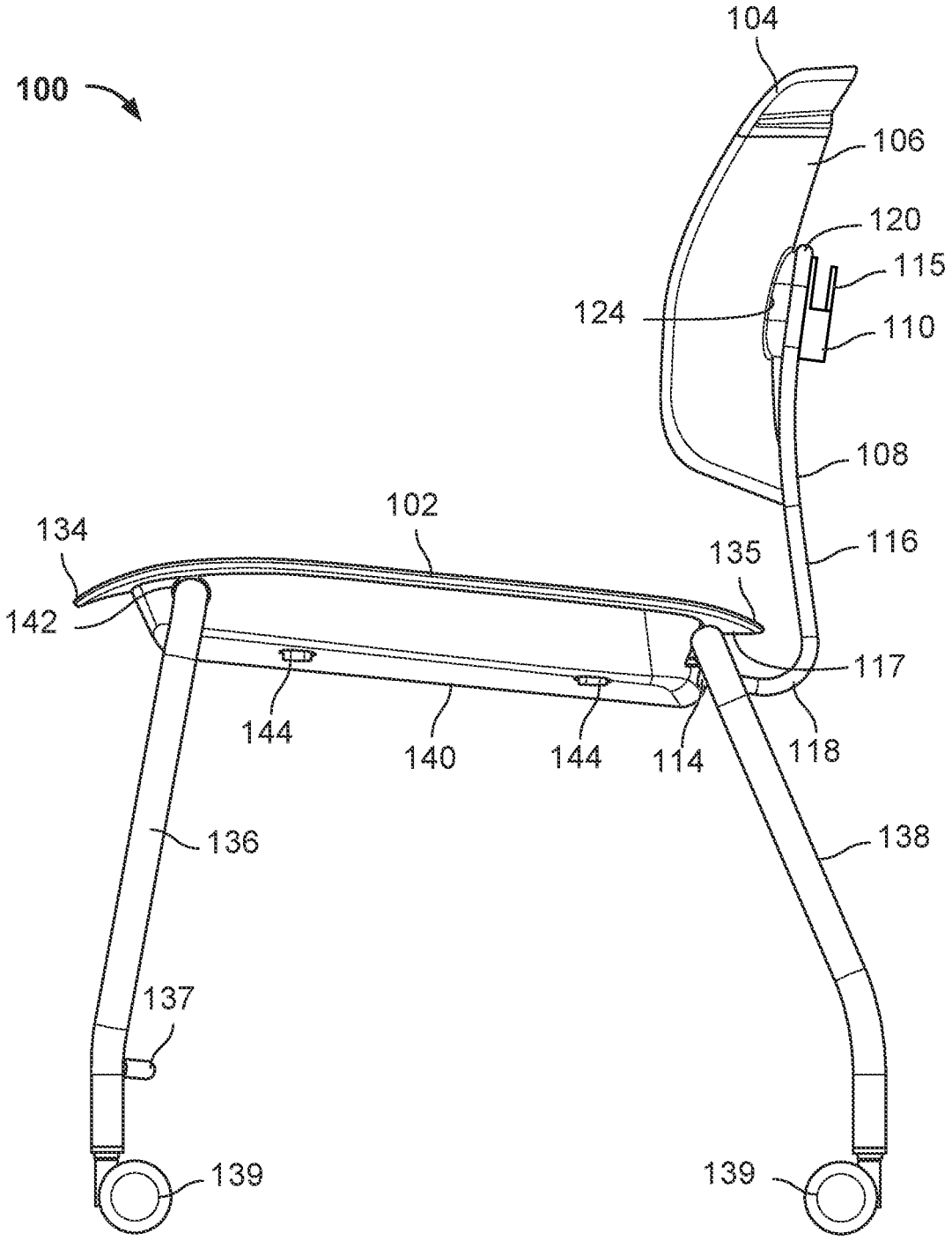
FIG. 2 is a side view of the chair shown in FIG. 1.
Figure 3:
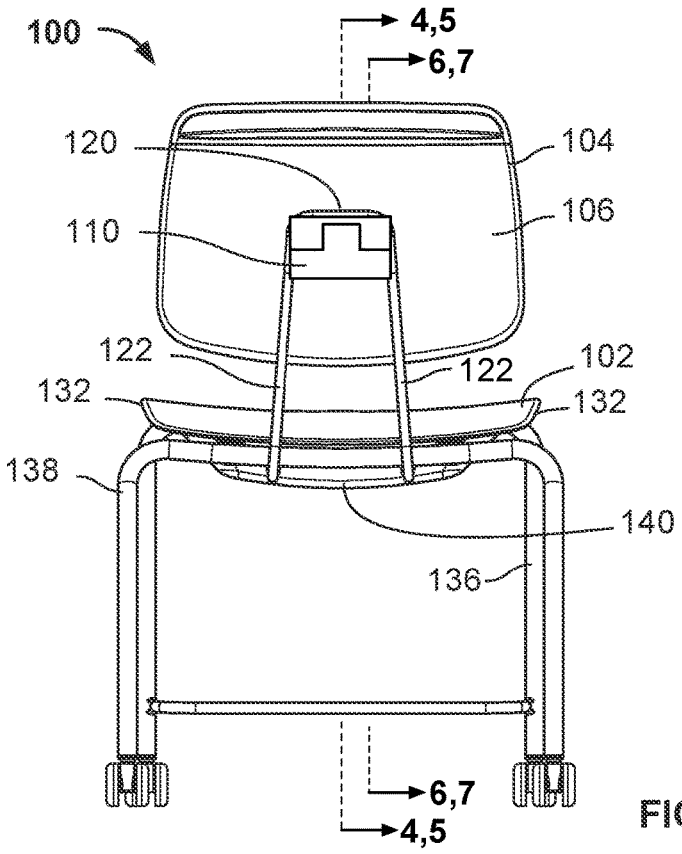
FIG. 3 is a rear view of the chair shown in FIG. 1.

Referring to FIG. 2, the upright portion 116 is concave from a side profile, having arms 122 that extend upward from the transition portion 118, slope inward towards the backrest 104, and inflect rearward prior to being adjoined at the upper loop 120. The upper loop 120 includes rounded shoulders and a horizontal connecting beam. With reference to FIG. 10, the weldment 146 may be secured between the arms 122 proximate the upper loop 120, and the backrest 104 is secured to the weldment 146 via fasteners 152.

With reference to FIGS. 1-3 and 8-12 the seat 102 is generally rectangular having a front edge 134 opposite the rear edge 135, and opposing lateral edges 132 extending between the front and rear edges 134 and 135. A bottom surface 117 of the seat 102 is securely attached to the top of the base (or frame) 156.

The seat 102 may optionally include flanges (best shown in FIGS. 11 and 12) that extend downward from the bottom surface 117 and form an interface for attaching with the base 156. The optional flanges may include apertures configured to align coaxially with apertures on the base 156 so that fasteners may be inserted therethrough to couple the seat 102 to the base 156. It should be understood that the seat 102 may be attached to the base 156 by any means commonly known in the prior art, and alternate embodiments for seating units 100 may or may-not include a seat 102 having flanges. Some seating units (not shown) may not include a base 156 or 256, but could, for example have a seat 102 that directly connects to the legs 136, 138.

In exemplary seating units 100 and 200 (shown in FIGS. 8-11 and 12, respectively), the base or frame 156 may include opposing lateral beams 158 that extend between the front and rear edges 134, 135 of the seat 102 and along the bottom surface 117. The lateral beams 158 are spaced inwardly from the various edges 132, 134, and 135 of the seat 102, providing clearance for a housing 140 to be disposed over and conceal the base 156, such that the housing 140 may be disposed flush against the bottom surface 117. As shown in FIGS. 8 and 12, the front legs 136 and the rear legs 138 may be secured directly, e.g., welded, fastened, press fit, etc., to the base 156 at ends of the lateral beams 158 adjacent the front and rear edges, 134 and 135, respectively.

The housing 140 conceals various connections between the frame 156, the seat 102, the legs 136, 138, and the horizontal portion 114 of support structure 108 (including shaped portions 128).

It should be noted that the housing 140 is drawn as a transparent structure in FIG. 8 so that the components within the housing's interior can be better visualized in the context of the complete seating unit assembly 100, but it is otherwise identical to the housings 140 shown in FIGS. 1-3 and 9-11. The exemplary housing 140 may be molded from a plastic material and may be transparent, translucent, or opaque, but the housing 140 may be formed from any suitable material, such as, for example, sheet metal.

Referring to FIGS. 1-3 and 8-11, the housing 140 comprises a substantially-hollow, domed structure having upwardly-vaulted walls, which terminate at the upper rim that rests flush against the bottom surface 117.

The housing 140 envelops the base 156, and a plurality of clips 144 may couple the housing 140 to the base 156. The housing 140 is generally rectangular when observed from the bottom view of FIG. 8, and openings 142 proximate corners of the housing 140 allow the legs 136, 138 to extend outwardly from the base and through the openings 142 prior to bending towards the floor. Openings 143 in the rear portion of the housing 140 (i.e., proximate the rear edge 135 of the seat 102) are provided so that the arms 122 of the horizontal portion 114 of the support member 108 may pass within the interior and extend curvilinearly along the bottom surface 117 of the seat 102.

Both exemplary seating units 100, 200 (shown in FIGS. 8 and 12, respectively) include a passageway 162 or 262 between the lateral beams 158 and below the rear edge 135 of the seat 102. The arms 122 of the horizontal portion 114 of the support member 108 are configured to extend through the passageway 162 or 262 and continue along the bottom surface 117. Specifically, the horizontal arms portion 114 of the support member 108 first traverses through openings 143 in the housing 140 (see FIG. 8), extends through the passageway 162 or 262, and continues extending along the bottom surface 117 in the general direction of the front edge 134. Distal ends 130 of the arms 122 are secured to interior sides 160 of the base 156 at securing locations 164, which may be disposed relatively closer to the front edge 134 than the rear edge 135.

In the first exemplary embodiment for the seating unit 100, shown in FIGS. 8-11, the frame 156 includes a crossbeam 159 extending between the lateral beams 158 proximate the rear edge 135 of the seat 102. The crossbeam 159 bows downward as it extends between the lateral beams 158, thereby creating a passageway 162 defined between the crossbeam 159 and the bottom surface 117 of the seat 102.

In a second embodiment, a seating unit 200, as shown in FIG. 12, includes a frame 156 having two lateral beams 158. Two parallel crossbeams 259 are vertically separated and integrally connected to the rear legs 138 beneath the rear edge 135 of the seat 102, and the passage 262 is defined between the parallel crossbeams 259. As such, each of exemplary seating units 100 and 200 includes a passage 162 or 262 beneath the seat 102 and being least partially defined by a crossbeam 159 or 259 extending perpendicularly between the lateral beams 158 of the frame the 156.

Figure 18:
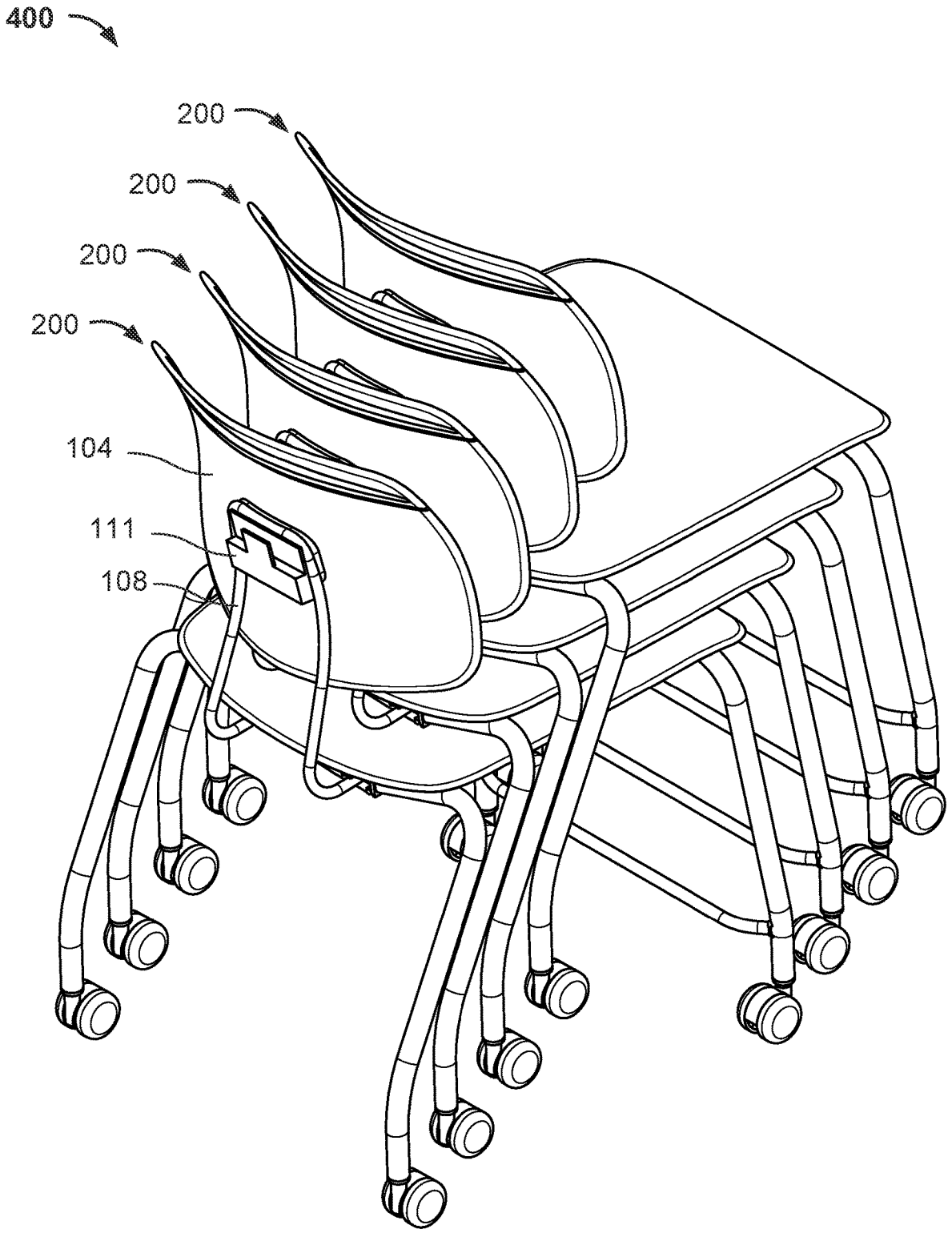
FIG. 18 is a perspective view showing a plurality of seating units of the present invention being stacked into vertical column.

Referring to FIGS. 9-12, the legs 136 and 138 may be generally U-shaped and extend outward and downward from the seat 102 proximate the front and rear edges 134 and 135, respectively. The legs 136, 138 may be integrally connected to the base 156 or may be fastened to the base 156 and/or beams 158, e.g., via welds or other permanent connections. The legs 136, 138 extend laterally outward from the base 156, pass through openings 142 in the exterior housing 140 and continue to extend laterally outward beyond the lateral edges 132 of the seat 102 prior to bending downward and extending in the general direction of the floor. The configuration provides legs having enough clearance to pass over the top of seats 102 of other seating units 100 or 200 so that plurality of seating units 400 may be stacked together in the form of a vertical column, as shown in FIG. 18.

Optionally, a footrest 137 may be secured between the front legs 136, and casters 145 may be optionally secured to distal ends of the legs 136, 138 to increase the seating unit's mobility.

What has been described above includes examples of the present invention. It is, of course, not possible to describe every conceivable combination of components or methodologies for purposes of describing the present invention, but one of ordinary skill in the art may recognize that many further combinations and permutations of the present invention are possible. Accordingly, the present invention is intended to embrace all such alterations, modifications, and variations that fall within the spirit and scope of the appended claims.

To apprise the public of the scope of this invention, the following claims are made:

What is claimed is:

1. A seating unit comprising:

a backrest extending substantially vertically above a seat, the backrest including an outwardly protruding rim formed integrally with a rear surface; and a hook assembly configured to couple with the backrest at the rim, wherein the rim at least partially circumscribes an attachment region including first mounting structures, and wherein the first mounting structures protrude outward from the rear surface.

2. The seating unit of claim 1, wherein a fastener is inserted substantially vertically through the hook assembly to securely couple the hook assembly to the backrest.

3. The seating unit of claim 1, wherein the first mounting structures are integrally formed with the backrest.

4. The seating unit of claim 1, wherein the first mounting structures comprise ribs having generally planar top and bottom surfaces.

5. The seating unit of claim 1, wherein the first mounting structures comprise ribs having a generally L-shaped cross section.

6. The seating unit of claim 1, wherein the hook assembly includes an interior surface, and wherein second mounting structures protrude outwardly from the interior surface and toward the first mounting structures.

7. The seating unit of claim 6, wherein, during assembly, at least one of the second mounting structures abuts against a first mounting structure to facilitate alignment of the hook assembly upon the backrest.

8. A seating unit comprising:

a backrest including an outwardly protruding rim formed on a rear surface, the backrest extending substantially vertically above a seat; and a hook assembly secured to the rear surface within the interior of the rim, the hook assembly including:

a cover plate, and a weldment, wherein the cover plate includes a hook, and the weldment is disposed in between the cover plate and rear surface.

9. The seating unit of claim 8, wherein the cover plate is securely coupled to the rear surface following receipt of a fastener inserted substantially parallel to the rear surface.

10. The seating unit of claim 9, wherein a head of the fastener is disposed within a recessed area of the cover plate following insertion of the fastener.

11. The seating unit of claim 8, wherein a cylindrical support member is secured to the rear surface of the backrest and extends between the backrest and the seat, the cylindrical support member including an upper loop that seats against the rim.

12. The seating unit of claim 8, wherein the hook assembly is configured to allow accessory articles to be retained with the backrest.

13. A seating unit comprising:

a backrest having a rim extending outward from a rear surface; and a hook assembly configured to be securely coupled to the backrest within the interior of the rim, wherein the hook assembly is securely coupled within the interior of the rim by a fastener that does not protrude through the rim, wherein the hook assembly includes a cover plate, and a weldment, and wherein the fastener extends through coaxially aligned apertures in the cover plate and the weldment.

14. The seating unit of claim 13, wherein the rim is integrally formed with the rear surface, and wherein the hook assembly further includes a hook.

15. The seating unit of claim 13, wherein the cover plate includes an interior surface, and a protrusion having a concave upper surface extends outwardly from the interior surface.

16. The seating unit of claim 13, wherein the cover plate is configured to be pivotably mounted upon the backrest prior to being securely coupled by the fastener.

17. The seating unit of claim 16, wherein the rim comprises one or more discrete rim segments, and the one or more discrete rim segments at least partially circumscribe an attachment area including first mounting structures.

18. The seating unit of claim 16, wherein a rib extends outwardly from the rear surface and defines a gap between the rear surface and a distal end of the rib, wherein the weldment is disposed within the gap, wherein the cover plate includes a protrusion disposed against a side of the rib opposite the gap, and wherein pivotally mounting the cover plate to the backrest compresses the protrusion against the rib, thereby compressing the rib against the weldment sufficient to secure the rib within the gap.

* * * * *